US006838218B2

(12) United States Patent
Hayashi et al.

(10) Patent No.: US 6,838,218 B2
(45) Date of Patent: Jan. 4, 2005

(54) BLACK TONER

(75) Inventors: Kazuyuki Hayashi, Hiroshima (JP); Hiroko Morii, Hiroshima (JP); Keisuke Iwasaki, Hiroshima (JP)

(73) Assignee: Toda Kogyo Corporation, Hiroshima-ken (JP)

( * ) Notice: Subject to any disclaimer, the term of this patent is extended or adjusted under 35 U.S.C. 154(b) by 0 days.

(21) Appl. No.: 10/162,702

(22) Filed: Jun. 6, 2002

(65) Prior Publication Data

US 2003/0138714 A1 Jul. 24, 2003

(30) Foreign Application Priority Data

Jun. 7, 2001 (JP) ..... 2001-173288
Mar. 5, 2002 (JP) ..... 2002-059440

(51) Int. Cl.[7] ..... G03G 9/00

(52) U.S. Cl. ..... 430/108.3; 430/108.6; 430/108.7; 430/108.9; 430/108.1

(58) Field of Search ..... 430/108.9, 108.3, 430/108.6, 108.7, 108.1, 111.4

(56) References Cited

U.S. PATENT DOCUMENTS 6,379,855 B1 * 4/2002 Hayashi et al. ..... 430/106.1
6,623,557 B2 * 9/2003 Hayashi et al. ..... 106/499
2002/0069790 A1 * 6/2002 Hayashi et al. ..... 106/482
2003/0022085 A1 * 1/2003 Hayashi et al. ..... 430/108.1
2003/0105213 A1 * 6/2003 Hayashi et al. ..... 524/492

FOREIGN PATENT DOCUMENTS

EP 0 945 766 A 9/1999
EP 1 076 266 A 2/2001
JP 08109337 A * 4/1996 ..... C09B/57/04
JP 08188723 A * 7/1996 ..... C09C/3/06

OTHER PUBLICATIONS

Kirk–Othmer Concise Encyclopedia of Chemical Technology. New York: John Wiley & Sons. (1985) p. 888.*
Database WPI, Section Ch, Week 199028, Derwent Publications Ltd., AN 1990–212061, XP002214572 and JP 02 140758 A (Konica), May 30, 1990), Abstract.

* cited by examiner

*Primary Examiner*—Christopher Rodee
(74) *Attorney, Agent, or Firm*—Nixon & Vanderhye P.C.

(57) ABSTRACT

A black toner comprises a binder resin and black composite particles having an average particle diameter of 0.005 to 0.30 μm, and comprising: extender pigments as core particles; a gluing agent-coating layer formed on surface of the respective core particles; and a black pigment coat uniformly formed on the gluing agent-coating layer in an amount of 1 to 500 parts by weight based on 100 parts by weight of the extender pigments. Such a black toner using black composite particles having not only excellent blackness, fluidity and light resistance, but also an excellent dispersibility in binder resins, which toner also exhibits excellent blackness, fluidity and light resistance.

14 Claims, 4 Drawing Sheets

0.1μm 0.1μm 0.1μm 0.1μm 0.1μm 0.1μm 0.1μm

BLACK TONER

BACKGROUND OF THE INVENTION

The present invention relates to a black toner, and more particularly, to a black toner using black composite particles having not only excellent blackness, fluidity and light resistance, but also an excellent dispersibility in binder resins, which toner also exhibits excellent blackness, fluidity and light resistance.

As recent image developing methods, there are mainly known a one-component developing method requiring no carrier, and a two-component developing method using both a black toner and a carrier. In the two-component developing method, the black toner is brought into frictional contact with the carrier in order to impart the black toner to an electrostatic charge having a signal reverse to that of an electrostatic latent image formed on a photosensitive member, cause the black toner to adhere onto the latent image by electrostatic attraction force therebetween, and neutralize the electrostatic charges having the opposite signals, thereby developing the electrostatic latent image into a visual toner image. As the black toner, there have been widely used composite particles obtained by mixing and dispersing black pigments such as fine carbon black particles in resins.

In presently predominant PPC-type copying machines, the black toner used in any of the developing methods has been required to have a good insulating property and/or a high resistivity. Specifically, the black toner has been required to have a volume resistivity value of not less than $1\times10^{13}$ Ω·cm.

Also, it is known that the behavior of a developer in a developing device strongly depends upon the fluidity of the developer which further influences a frictional electrification property between the black toner and the carrier in the two-component developing method or an electrification property of the black toner on a sleeve in the one-component developing method. Thus, with the recent tendency toward high image qualities such as high image density and excellent tone gradation as well as high speed of the developing device, it has been strongly required to enhance the fluidity of the black toner.

Further, with the recent tendency toward reduction in particle size of the black toner, it has been more strongly required to improve the fluidity of the black toner.

As to this fact, at page 121 of "Comprehensive Technical Data for Development and Utilization of Toner Materials (1985)", it is described that "With the wide spread of printers such as IPC, printed images have been required to have a high quality. In particular, it has been required to develop high-definition and high-accuracy printers. As is apparent from Table 1 showing a relationship between various toners and definitions of images obtained, the wet toner having a smaller particle size can realize a higher definition of images. Also, in order to enhance the definition of images obtained using a dry toner, the reduction in particle size of the toners is similarly required. . . . As to toners having a small particle size, it has been reported that the by using a toner having a particle size of 8.5 to 11 μm, the generation of fog in background area can be inhibited and the amount of toner consumed is reduced. Further, by using a polyester-based toner having a particle size of 6 to 10 μm, there can be become a high image quality, stable electrification property and prolonged service life of the developer. However, such toners having a small particle size have many problems to be solved upon using, such as productivity, sharpness of particle size distribution, improvement in fluidity . . . or the like.".

In addition, it has been required that the black toner can exhibit linear and solid-area copy images having high blackness and high image density.

As to this fact, at page 272 of the above "Comprehensive Technical Data for Development and Utilization of Toner Materials", it is described that ". . . although the development using a powdery toner is characterized by high image density, not only fog concentration but also image properties as described later are largely influenced".

Further, recording papers having images printed with the black toner are usually preserved for a long period of time after printing. Therefore, the black toner is required to have an excellent light resistance in order to keep clear printed images.

As described above, the black toner has been strongly required to be improved in various properties thereof. In particular, it is known that black pigments exposed to the surface of the black toner considerably influence developing characteristics of the black toner. Thus, various properties of the black toner have a close relationship with those of the black pigments mixed and dispersed in the black toner.

Namely, since the fluidity of the black toner largely varies depending upon the surface conditions of the black pigments exposed to the surface of the black toner, the black pigments themselves have been strongly required to exhibit an excellent fluidity. Also, the degrees of blackness and density of the black toner largely vary depending upon those of the black pigments contained in the black toner. Further, the light resistance of the black toner largely varies depending upon that of the black pigments contained in the black toner.

As the conventional attempt for improving the blackness of non-magnetic particles, there is known a method of forming a coating layer comprising organosilane compounds obtainable from alkoxysilane compounds or polysiloxanes, on the surface of respective hematite particles or iron oxide hydroxide particles, and then forming carbon black coat on the coating layer (Japanese Patent Application Laid-Open (KOKAI) Nos. 11-338191(1999) and 2001-13730). Also, as the conventional attempt for tinting magnetic particles, there are known a method of coating the surface of the respective magnetic particles with a colorant through a coupling agent (Japanese Patent Application Laid-Open (KOKAI) No. 60-26954(1985)); a method of tinting the magnetic particles with dyes (Japanese Patent Application Laid-Open (KOKAI) No. 59-57249(1984)); or the like.

At present, it has been strongly required to provide a black toner exhibiting excellent blackness, fluidity and light resistance. However, conventional black toners have failed to satisfy such properties.

That is, in the case where the known fine carbon black particles are used as black particles for the black toner, the amount of the fine carbon black particles used in the black toner must be limited to a certain low level in order to obtain such a black toner having a volume resistively value as high as not less than $1\times10^{13}$ Ω·cm. As a result, there arises a problem that the black toner is insufficient in not only blackness but also fluidity.

Also, in Japanese Patent Application Laid-Open (KOKAI) Nos. 11-338191 (1999) and 2001-13730, there are described the black non-magnetic particles obtained by forming the coating layer comprising organosilane compounds obtainable from alkoxysilane compounds or polysiloxanes, on the surface of the respective hematite particles or iron oxide hydroxide particles as core particles, and then forming carbon black coat on the coating layer. However, since the hematite particles and the iron oxide hydroxide particles have a specific gravity as high as 4.3 to 5.5 and the amount of carbon black adhered onto the surface of the core particles is as small as about 25 parts by weight based on 100 parts by weight of the core particles, the obtained black non-magnetic particles also have a high specific gravity, thereby failing to obtain black particles for black toner having a low specific gravity, for example, not more than 3.5. Further, since the hematite particles and the ferric oxide hydroxide particles are insufficient in fluidity, the toner obtained using such particles also fails to exhibit a sufficient fluidity.

In Japanese Patent Application Laid-Open (KOKAI) No. 60-26954(1985), there are described the magnetic particles coated with a colorant. However, it is difficult to completely shield and hide the hue of the magnetic particles as core particles, thereby failing to obtain a black toner having a high blackness.

In addition, in Japanese Patent Application Laid-Open (KOKAI) No. 59-57249(1984), there are described the magnetic particles tinted with dyes. However, since the dyes are used as a colorant, the obtained particles fail to show a sufficient light resistance.

As a result of the present inventors' earnest studies, it has been found that by using black composite particles having an average particle diameter of 0.005 to 0.30 $\mu$m and exhibiting excellent blackness, fluidity and light resistance, which comprise extender pigments as core particles, a gluing agent-coating layer formed on the surface of the core particle and a black pigment coat uniformly formed on the gluing agent-coating layer, the obtained black toner can exhibit excellent blackness, fluidity and light resistance. The present invention has been attained based on the above finding.

SUMMARY OF THE INVENTION

An object of the present invention is to provide a black toner exhibiting excellent blackness, fluidity and light resistance.

To accomplish the aim, in a first aspect of the present invention, there is provided a black toner comprising black composite particles having an average particle diameter of 0.005 to 0.30 $\mu$m, and a binder resin, said black composite particles comprising:

extender pigments as core particles;

a gluing agent-coating layer formed on the surface of the respective core particles; and a black pigment coat uniformly formed on the gluing agent-coating layer in an amount of 1 to 500 parts by weight based on 100 parts by weight of the extender pigments.

In a second aspect of the present invention, there is provided a black toner comprising black composite particles having an average particle diameter of 0.005 to 0.30 um, and a binder resin, said black composite particles comprising:

extender pigments as core particles;

a coating layer formed on the surface of the respective extender pigments, comprising at least one compound selected from the group consisting of hydroxides of aluminum, oxides of aluminum, hydroxides of silicon and oxides of silicon;

a gluing agent-coating layer formed on said coating layer; and a black pigment coat uniformly formed on the gluing agent-coating layer in an amount of 1 to 500 parts by weight based on 100 parts by weight of the extender pigments.

In a third aspect of the present invention, there is provided a black toner having an average particle diameter of 3 to 25 $\mu$m; a L* value of not more than 22.0; and a fluidity index of 76 to 100, and comprising a binder resin and black composite particles having an average particle diameter of 0.005 to 0.30 $\mu$m.

said black composite particles comprising:

extender pigments as core particles;

a gluing agent-coating layer formed on the surface of the respective core particles; and a black pigment coat uniformly formed on the gluing agent-coating layer in an amount of 1 to 500 parts by weight based on 100 parts by weight of the extender pigments.

In a fourth aspect of the present invention, there are provided black composite particles comprising:

extender pigments as core particles;

a gluing agent-coating layer formed on the surface of the respective core particles; and a black pigment coat uniformly formed on the gluing agent-coating layer in an amount of 1 to 500 parts by weight based on 100 parts by weight of the extender pigments.

In a fifth aspect of the present invention, there are provided black composite particles having a BET specific surface area value of 15 to 500 $m^2/g$; a blackness (L* value) of not more than 22.0; a specific gravity of 1.3 to 3.5 and a fluidity index of not less than 45, and comprising:

extender pigments as core particles;

a gluing agent-coating layer formed on the surface of the respective core particles; and a black pigment coat uniformly formed on the gluing agent-coating layer in an amount of 1 to 500 parts by weight based on 100 parts by weight of the extender pigments.

In a sixth aspect of the present invention, there is provided an electrostatic developing method for developing an electrostatic latent image with a black developer, wherein the black developer comprises a black toner comprising a binder resin and black composite particles having an average particle diameter of 0.005 to 0.30 $\mu$m and comprising extender pigments as core particles, a gluing agent-coating layer formed on the surface of the respective core particles, and a black pigment coat uniformly formed on the gluing agent-coating layer in an amount of 1 to 500 parts by weight based on 100 parts by weight of the extender pigments.

In a seventh aspect of the present invention, there is also provided an electrostatic developing method for developing an electrostatic latent image with a black developer, wherein the black developer comprises a magnetic carrier and a black toner comprising a binder resin and black composite particles having an average particle diameter of 0.005 to 0.30 $\mu$m and comprising extender pigments as core particles, a gluing agent-coating layer formed on the surface of the respective core particles, and a black pigment coat uniformly formed on the gluing agent-coating layer in an amount of 1 to 500 parts by weight based on 100 parts by weight of the extender pigments, and a magnetic carrier, are used as a black developer.

In an eighth aspect of the present invention, there is provided a colorant for black toner, having an average particle diameter of 0.005 to 0.30 $\mu$m, comprising:

extender pigments as core particles;

a gluing agent-coating layer formed on surface of the respective core particles; and a black pigment coat uniformly formed on the gluing agent-coating layer in an amount of 1 to 500 parts by weight based on 100 parts by weight of the extender pigments.

DETAILED DESCRIPTION OF THE INVENTION

Figure 1:
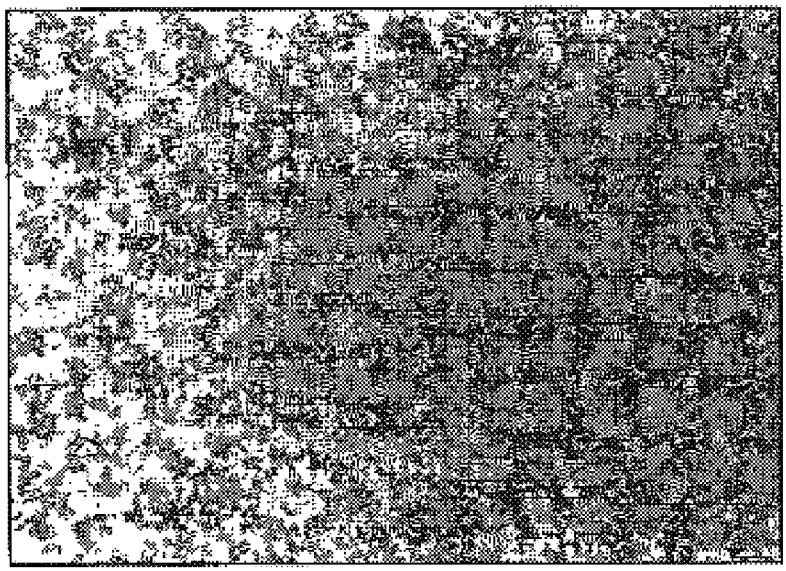
FIG. 1 is a micrograph (×50,000) of silica particles used in Example 1.

The present invention will now be described in detail below.

First, the black composite particles for black toner according to the present invention are described.

As the extender pigments used in the present invention, there may be exemplified silica particles such as silica powder, white carbon particles, fine silicic acid powder and diatomaceous earth particles, clay particles, calcium carbonate particles, barium sulfate particles such as precipitated barium sulfate particles, alumina white particles, talc, transparent titanium oxide particles, satin white particles, or the like. Among these extender pigments, silica particles are preferred in the consideration of fluidity of the obtained black composite particles for a black toner.

The extender pigments may be of any suitable shape such as spherical shape, granular shape, polyhedral shape, acicular shape, spindle shape, rice ball-like shape, flake-like shape, scale-like shape and plate shape. In the consideration of the fluidity of the obtained black composite particles for black toner, spherical particles or granular particles having a sphericity (ratio of average particle diameter to average minimum diameter; hereinafter referred to merely as "sphericity") of from 1.0 to less than 2.0, are preferred.

The extender pigments as the core particles have an average particle diameter of preferably 0.004 to 0.29 $\mu$m, more preferably 0.005 to 0.24 $\mu$m, still more preferably 0.006 to 0.19 $\mu$m.

When the average particle diameter of the extender pigments as core particles is more than 0.29 $\mu$m, the obtained black composite particles may become coarse, so that the black composite particles may tend to be deteriorated in dispersibility. When the average particle diameter of the extender pigments is less than 0.004 $\mu$m, such particles may tend to be agglomerated due to fine particles. As a result, it may be difficult to form a uniform gluing agent-coating layer on the surface of the extender pigments, and uniformly adhere the black pigments in the form of a uniform adhesion coat onto the surface of the gluing agent-coating layer.

The extender pigments have a BET specific surface area value of preferably not less than 15 $m^2/g$. In consideration of the dispersibility, the BET specific surface area value is more preferably not less than 20 $m^2/g$, still more preferably not less than 25 $m^2/g$. When the BET specific surface area value is less than 15 $m^2/g$, the extender pigments may become coarse and the obtained black composite particles may also become coarse, so that such a coarse black composite particles may tend to be deteriorated in dispersibility. In the consideration of forming a uniform gluing agent-coating layer on the surface of the extender pigments and uniformly adhering the black pigments in the form of a uniform adhesion coat onto the surface of the gluing agent-coating layer, the upper limit of the BET specific surface area value of the extender pigments is preferably 500 $m^2/g$, more preferably 4000 $m^2/g$, still more preferably 300 $m^2/g$.

The extender pigments as the core particles used in the present invention have a specific gravity of preferably 1.3 to 4.2, more preferably 1.4 to 3.8, still more preferably 1.5 to 3.4. When the specific gravity of the core particles is more than 4.2, the specific gravity of the obtained black composite particles for a black toner may also become too high.

As to the fluidity of the extender pigments, the fluidity index thereof is preferably not less than 40, more preferably 43 to 80, still more preferably 46 to 80. When the fluidity index is less than 40, the extender pigments may fail to show a good fluidity, so that it may be difficult to obtain a black composite particles for black toner having an excellent fluidity.

As to the hue of the extender pigments as the core particles, the C* value thereof is preferably not more than 16.0, more preferably not more than 14.0, still more preferably not more than 12.0. When the C* value of the core particles is more than 16.0, it may be difficult to obtain the aimed black composite particles exhibiting a high blackness because of a high hue of the core particles.

The extender pigments used in the present invention have a hiding power of preferably less than 300 $cm^2/g$, more preferably not more than 200 $cm^2/g$, still more preferably not more than 100 $cm^2/g$. When the hiding power of the extender pigments is not less than 300 $cm^2/g$, it may be difficult to obtain a black composite particles having a high blackness.

The gluing agent used in the present invention may be of any kind as long as the black pigment can be adhered onto the surface of the extender pigment therethrough. Examples of the preferred gluing agents may include organosilicon compounds such as alkoxysilanes, fluoroalkylsilanes and polysiloxanes; various coupling agents such as silane-based coupling agents, titanate-based coupling agents, aluminate-based coupling agents and zirconate-based coupling agents; oligomer compounds; polymer compounds; or the like. These gluing agents may be used alone or in the form of a mixture of any two or more thereof. In the consideration of adhesion strength of the black pigment onto the surface of the extender pigments through the gluing agent, the more preferred gluing agents are the organosilicon compounds such as alkoxysilanes, fluoroalkylsilanes and polysiloxanes, and various coupling agents such as silane-based coupling agents, titanate-based coupling agents, aluminate-based coupling agents and zirconate-based coupling agents.

In particular, in the case where silica particles are used as the core particles, the gluing agent is preferably composed of organosilicon compounds or a silane-based coupling agent. Also, in the case where fine carbon black particles are used as the black pigments, the gluing agent is preferably composed of organosilicon compounds.

As organosilicon compounds used in the present invention, at least one organosilicon compound selected from the group consisting of (1) organosilane compounds obtained from alkoxysilane compounds; (2) polysiloxanes, or modified polysiloxanes selected from the group consisting of (2-A) polysiloxanes modified with at least one compound selected from the group consisting of polyethers, polyesters and epoxy compounds (hereinafter referred to merely as "modified polysiloxanes"), and (2-B) polysiloxanes whose molecular terminal is modified with at least one group selected from the group consisting of carboxylic acid groups, alcohol groups and a hydroxyl group; and (3) fluoroalkyl organosilane compounds obtained from fluoroalkylsilane compounds.

The organosilane compounds (1) can be produced from alkoxysilane compounds represented by the formula (I):

$$R^1_aSiX_{4-a} \quad (I)$$

wherein $R^1$ is $C_6H_5$—, $(CH_3)_2CHCH_2$— or n-$C_bH_{2b+1}$— (wherein b is an integer of 1 to 18); X is $CH_3O$— or $C_2H_5O$—; and a is an integer of 0 to 3.

Specific examples of the alkoxysilane compounds may include methyltriethoxysilane, dimethyldiethoxysilane, phenyltriethyoxysilane, diphenyldiethoxysilane, dimethyldimethoxysilane, methyltrimethoxysilane, phenyltrimethoxysilane, diphenyldimethoxysilane, isobutyltrimethoxysilane, decyltrimethoxysilane or the like. Among these alkoxysilane compounds, in view of the degree of desorption of the black pigments, methyltriethoxysilane, methyltrimethoxysilane, dimethyldimethoxysilane, isobutyltrimethoxysilane and phenyltriethyoxysilane are preferred, and methyltriethoxysilane and methyltrimethoxysilane are more preferred.

As the polysiloxanes (2), there may be used those compounds represented by the formula (II):

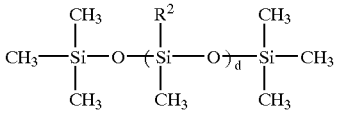

(II)

wherein $R^2$ is H— or $CH_3$—, and d is an integer of 15 to 450.

As the modified polysiloxanes (2-A), there may be used:

(a1) Polysiloxanes Modified with Polyethers Represented by the Formula (III):

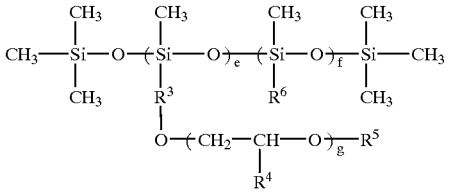

(III)

wherein $R^3$ is —(—$CH_2$—)$_h$—; $R^4$ is —(—$CH_2$—)$_i$—$CH_3$; $R^5$ is —OH, —COOH, —CH═$CH_2$, —CH($CH_3$)═$CH_2$ or —(—$CH_2$—)$_j$—$CH_3$; $R^6$ is —(—$CH_2$—)$_k$—$CH_3$; g and h are an integer of 1 to 15; i, j and k are an integer of 0 to 15; e is an integer of 1 to 50; and f is an integer of 1 to 300;

(a2) Polysiloxanes Modified with Polyesters Represented by the Formula (IV):

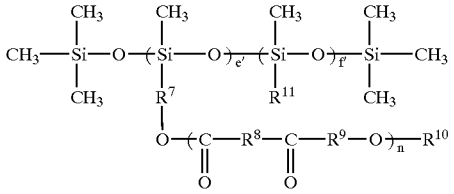

(IV)

wherein $R^7$, $R^8$ and $R^9$ are —(—$CH_2$—)$_q$— and may be the same or different; $R^{10}$ is —OH, —COOH, —CH═$CH_2$, —CH($CH_3$)═$CH_2$ or —(—$CH_2$—)$_r$—$CH_3$; $R^{11}$ is —(—$CH_2$—)$_s$—$CH_3$; n and q are an integer of 1 to 15; r and s are an integer of 0 to 15; e' is an integer of 1 to 50; and f' is an integer of 1 to 300;

(a3) Polysiloxanes Modified with Epoxy Compounds Represented by the Formula (V):

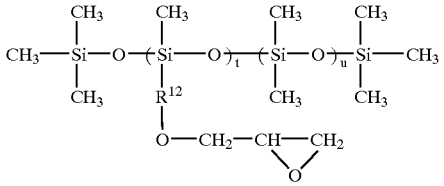

(V)

wherein $R^{12}$ is —(—$CH_2$—)$_v$—; v is an integer of 1 to 15; t is an integer of 1 to 50; and u is an integer of 1 to 300; or a mixture thereof.

As the terminal-modified polysiloxanes (2-B), there may be used those represented by the formula (VI):

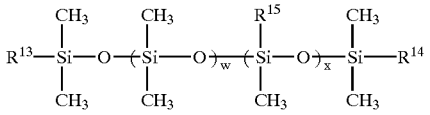

(VI)

wherein $R^{13}$ and $R^{14}$ are —OH, $R^{16}$OH or $R^{17}$COOH and may be the same or different; $R^{15}$ is —$CH_3$ or —$C_6H_5$; $R^{16}$ and $R^{17}$ are —(—$CH_2$—)$_y$—; wherein y is an integer of 1 to 15; w is an integer of 1 to 200; and x is an integer of 0 to 100.

In view of the degree of desorption of the black pigment, polysiloxanes having methyl hydrogen siloxane units, the polysiloxanes modified with the polyethers and the polysiloxanes whose terminals are modified with carboxylic acid groups are preferred.

The fluoroalkyl organosilane compounds (3) may be produced from fluoroalkylsilane compounds represented by the formula (VII):

$$CF_3(CF_2)_zCH_2CH_2(R^{18})_{a'}SiX_{4-a'} \quad (VII)$$

wherein $R^{18}$ is $CH_3$—, $C_2H_5$—, $CH_3O$— or $C_2H_5O$—; X is $CH_3O$— or $C_2H_5O$—; and z is an integer of 0 to 15; and a' is an integer of 0 to 3.

Specific examples of the fluoroalkylsilane compounds may include trifluoropropyl trimethoxysilane, tridecafluorooctyl trimethoxysilane, heptadecafluorodecyl trimethoxysilane, heptadecafluorodecylmethyl dimethoxysilane, trifluoropropyl ethoxysilane, tridecafluorooctyl triethoxysilane, heptadecafluorodecyl triethoxysilane, or the like. Among these fluoroalkylsilane compounds, in view of the degree of desorption of the black pigment, trifluoropropyl trimethoxysilane, tridecafluorooctyl trimethoxysilane and heptadecafluorodecyl trimethoxysilane are preferred, and trifluoropropyl trimethoxysilane and tridecafluorooctyl trimethoxysilane are more preferred.

As the silane-based coupling agents, there may be exemplified vinyltrimethoxysilane, vinyltriethoxysilane, γ-aminopropyltriethoxysilane, γ-glycidoxypropyltrimethoxysilane, γ-mercaptopropyltrimethoxysilane, γ-methacryloxypropyltrimethoxysilane, N-β(aminoethyl)-γ-aminopropyltrimethoxysilane, γ-glycidoxypropylmethyldimethoxysilane, γ-chloropropyltrimethoxysilane or the like.

As the titanate-based coupling agents, there may be exemplified isopropyltristearoyl titanate, isopropyltris(dioctylpyrophosphate)titanate, isopropyltri(N-aminoethylaminoethyl)titanate, tetraoctylbis(ditridecylphosphate)titanate, tetra(2,2-diaryloxymethyl-1-butyl)bis(ditridecyl)phosphate titanate, bis(dioctylpyrophosphate)oxyacetate titanate, bis(dioctylpyrophosphate)ethylene titanate or the like.

As the aluminate-based coupling agents, there may be exemplified acetoalkoxyaluminum diisopropilate, aluminumdiisopropoxymonoethylacetoacetate, aluminumtrisethylacetoacetate, aluminumtrisacetylacetonate or the like.

As the zirconate-based coupling agents, there may be exemplified zirconiumtetrakisacetylacetonate, zirconiumdibutoxybisacetylacetonate, zirconiumtetrakisethylacetoacetate, zirconiumtributoxymonoethylacetoacetate, zirconiumtributoxyacetylacetonate or the like.

It is preferred to use oligomer compounds having a molecular weight of from 300 to less than 10,000. It is preferred to use polymer compounds having a molecular weight of about 10,000 to about 100,000. In the consideration of forming a uniform coating layer on the core particles, the oligomers or polymer compounds are preferably in a liquid state, or soluble in water or various solvents.

The amount of the gluing agent-coating layer is preferably 0.01 to 15.0% by weight, more preferably 0.02 to 12.5% by weight, still more preferably 0.03 to 10.0% by weight (calculated as C) based on the weight of the gluing agent-coated core particles.

When the amount of the gluing agent-coating layer is less than 0.01% by weight, it may be difficult to adhere not less than one part by weight of the black pigment onto 100 parts by weight of the core particles. When the amount of the gluing agent-coating layer is more than 15.0% by weight, since it is possible to adhere 1 to 500 parts by weight of the black pigment onto 100 parts by weight of the core particles therethrough, it is unnecessary to form the gluing agent-coating layer in an amount of more than 15.0% by weight.

As the black pigments use in the adhering treatment, there may be used carbon black particles such as furnace black particles, channel black particles and acetylene black particles, and organic black-based pigments such as aniline black. In the consideration of the tinting strength of the obtained black composite particles, the carbon black particles are preferred, and in the consideration of the volume resistivity value of the obtained black composite particles, the aniline black is preferred.

Specific examples of the carbon black particles may include #3050, #3150, #3250, #3750, #3950, MA100, MA7, #1000, #2400B, #30, MA77, MA8, #650, MA11, #50, #52, #45, #2200B and MA600 (tradenames; produced by Mitsubishi Kagaku Co., Ltd.), SEAST 9H, SEAST 7H, SEAST 6, SEAST 3H, SEAST 300 and SEAST FM (tradenames; produced by Tokai Carbon Co., Ltd.), RAVEN 1250, RAVEN 860, RAVEN 1000 and RAVEN 1190ULTRA (tradenames; produced by Colombian Chemicals Co.), KETJHEN BLACK EC and KETJHEN BLACK EC600JD (tradenames; produced by Ketjhen Black International Company), BLACK PEARLS-L, BLACK PEARLS 1000, BLACK PERLS 4630, VULCAN XC72, REGAL 660 and REGAL 400 (tradenames; produced by Cabot Specialty Chemicals Inc.), or the like.

The amount of the black pigments adhered is usually 1 to 500 parts by weight, preferably 5 to 400 parts by weight, more preferably 30 to 400 parts by weight, still more preferably 50 to 300 parts by weight based on 100 parts by weight of the extender pigments.

When the amount of the black pigments adhered is less than one part by weight, the amount of the black pigments coated on the surface of the extender pigments is too small, so that it may be difficult to obtain the aimed black composite particles having a high blackness. When the amount of the black pigments adhered is more than 500 parts by weight, the black pigments tend to be desorbed from the surface of the obtained black composite particles because of a too large amount of the black pigments adhered. As a result, the resultant black composite particles may tend to be deteriorated in dispersibility in the binder resin.

The particle shape and particle size of the black composite particles for black toner according to the present invention may mainly depend upon those of the extender pigments as core particles. Specifically, the black composite particles may have a particle shape similar to that of the core particles, and have a slightly larger particle size than that of the core particles.

More specifically, the black composite particles for black toner according to the present invention has an average particle diameter of usually 0.005 to 0.30 μm, preferably 0.006 to 0.25 μm, more preferably 0.007 to 0.20 μm.

When the average particle diameter of the black composite particles is more than 0.30 μm, the obtained black composite particles tends to be deteriorated in dispersibility in binder resin because of too large particle diameter thereof. When the average particle diameter of the black composite particles is less than 0.005 μm, the black composite particles tends to be agglomerated by the increase of intermolecular force therebetween due to fine particles, resulting in poor dispersibility in binder resin.

The black composite particles for black toner according to the present invention has a BET specific surface area value of preferably 15 to 500 $m^2/g$, more preferably 20 to 400 $m^2/g$, still more preferably 25 to 300 $m^2/g$. When the BET specific surface area value of the black composite particles is less than 15 $m^2/g$, the obtained black composite particles may be in the form of coarse particles, resulting in poor dispersibility in binder resin. When the BET specific surface area value of the black composite particles is more than 500 $m^2/g$, the black composite particles tends to be agglomerated together by the increase of intermolecular force therebetween due to fine particles, resulting in poor dispersibility in binder resin.

The black composite particles for black toner according to the present invention has a specific gravity of preferably 1.3 to 3.5, more preferably 1.4 to 3.0, still more preferably 1.5 to 2.5. In the case where the amount of the black composite particles blended in binder resin is kept constant, when the specific gravity of the black composite particles is more than 3.5, the volume of the black composite particles per unit volume of the black toner becomes too small, thereby failing to exhibit a sufficient tinting strength. As a result, it may be difficult to obtain a black toner having a sufficient blackness.

As to the fluidity of the black composite particles for black toner according to the present invention, the fluidity index thereof is preferably not less than 45, more preferably not less than 50, still more preferably 55 to 90. When the fluidity index of the black composite particles is less than 45, the obtained black composite particles may fail to show an excellent fluidity, so that it may be difficult to further improve the fluidity of a black toner obtained from the black composite particles.

As to the blackness of the black composite particles, the L* value thereof is preferably not more than 22.0, more preferably not more than 21.0, still more preferably not more than 20.0. When the L* value is more than 22.0, the obtained black composite particles tend to have a too high brightness, thereby failing to exhibit an excellent blackness. The lower limit of the L* value of the black composite particles is usually 14.5.

The tinting strength of the black composite particles according to the present invention is preferably not less than 115%, more preferably not less than 120%, when measured by the below-mentioned evaluation method.

As to the light resistance of the black composite particles according to the present invention, the ΔE* value thereof is preferably not more than 3.0, more preferably not more than 2.5, still more preferably not more than 2.0 when measured by the below-mentioned evaluation method. When the ΔE* value is more than 3.0, images printed with a black toner using such a black composite particles may fail to show a sufficient light resistance.

The degree of desorption of the black pigments from the black composite particles according to the present invention is preferably the rank 5 or 4, more preferably the rank 5 when visually observed and evaluated by the below-mentioned method. When the degree of desorption of the black pigments is the rank 1, 2 or 3, uniform dispersion of the black composite particles tends to be inhibited by the desorbed black pigments.

In the black composite particles for black toner according to the present invention, if required, the surface of the core particle may be previously coated with at least one compound selected from the group consisting of hydroxides of aluminum, oxides of aluminum, hydroxides of silicon and oxides of silicon. The black composite particles for black toner, produced by using the core particles having such a coat composed of at least one compound selected from the group consisting of hydroxides of aluminum, oxides of aluminum, hydroxides of silicon and oxides of silicon (hereinafter referred to merely as "intermediate coat"), can be more effectively reduced in amount of black pigments desorbed from the surface of the extender pigments as compared to those using the core particles having no intermediate coat.

The amount of the intermediate coat is preferably 0.01 to 20% by weight (calculated as Al, $SiO_2$ or a sum of Al and $SiO_2$) based on the weight of the extender pigments as the core particles coated with the intermediate coat.

When the amount of the intermediate coat is less than 0.01% by weight, it may be difficult to attain the effect of reducing the amount of black pigments desorbed. As long as the amount of the intermediate coat is in the range of 0.01 to 20% by weight, the effect of reducing the amount of black pigments desorbed can be sufficiently attained. Therefore, it is unnecessary to form the intermediate coat in an amount of more than 20% by weight.

The black composite particles produced by using as the core particles the extender pigments having the intermediate coat according to the present invention are substantially the same in particle size, BET specific surface area value, specific gravity, fluidity, blackness, tinting strength and light resistance as those of the black composite particles produced by using the extender pigments as the core particles having no intermediate coat according to the present invention. The degree of desorption of the black pigments from the black composite particles can be improved by forming the intermediate coat on the extender pigments as the core particles such that the black composite particles can show a black pigment desorption degree of preferably the rank 5.

Next, the black toner containing the black composite particles of the present invention is described.

The black toner of the present invention comprises the black composite particles for black toner according to the present invention, and a binder resin, and may further contain, if required, a mold-releasing agent, a charge controller and other additives.

The black toner of the present invention has an average particle diameter of preferably 3 to 25 μm, more preferably 4 to 18 μm, still more preferably 5 to 15 μm.

The amount of the black composite particles contained in the black toner is preferably 1.2 to 20.0% by weight, more preferably 1.8 to 19.0% by weight, still more preferably 2.4 to 18.0% by weight.

As the binder resin, there may be used polyester-based resins; epoxy-based resins; polyolefin-based resins; polyurethane-based resins; vinyl-based polymers obtained by polymerizing or copolymerizing vinyl-based monomers such as styrene, alkyl acrylates and alkyl methacrylates; styrene-butadiene copolymers; or the like. Examples of the styrene monomers may include styrene and substituted styrenes. Examples of the alkyl acrylate monomers may include acrylic acid, methyl acrylate, ethyl acrylate, butyl acrylate or the like. These resins may be used alone or in the form of a mixture of any two or more thereof.

As to the fluidity of the black toner, the fluidity index thereof as described in detail below is preferably 76 to 100, more preferably 78 to 100, still more preferably 80 to 100. When the fluidity index is less than 78, the black toner may fail to show a more excellent fluidity.

As to the blackness of the black toner, the L* value thereof is preferably not more than 22.0, more preferably not more than 21.0, still more preferably not more than 20.0. When the L* value is more than 22.0, the black toner may have a too high brightness, thereby failing to exhibit a sufficient blackness. The lower limit of the L* value of the black toner is usually 14.5.

As to the light resistance of the black toner, the ΔE* value thereof is preferably not more than 4.0, more preferably not more than 3.5, still more preferably not more than 3.0 as measured by the below-mentioned evaluation method.

The black toner has a volume resistivity value of preferably not less than $1.0\times10^{13}$ Ω·cm, more preferably not less than $2.5\times10^{13}$ Ω·cm, still more preferably not less than $5.0\times10^{13}$ Ω·cm. When the volume resistivity value of the black toner is less than $1.0\times10^{13}$ Ω·cm, the electrification amount of the black toner tends to be varied according to conditions under which the black toner is used, resulting in unstable properties thereof. The upper limit of the volume resistivity value of the black toner is usually $1.0\times10^{17}$ Ω·cm.

Next, the developing method of the present invention is described.

The developing method of the present invention is an electrostatic developing method for developing an electrostatic latent image with a toner comprising a thermoplastic resin and pigments as main components, wherein the black toner of the present invention is used as the toner.

Specifically, as the non-magnetic one-component developing method according to the present invention, there is used such a magnetic latent image-developing method comprising forming a magnetic latent image on an image-retaining member made of a magnetic material; supplying a developer containing a toner onto a non-magnetic sleeve opposite to the image-retaining member and provided therein with a magnetic field-generating member to form a magnetic brush on the non-magnetic sleeve; and bringing the magnetic brush formed on the sleeve into a slide contact with the surface of the image-retaining member to develop the magnetic latent image into a visual toner image.

Also, in the two-component developing method used in the present invention, there is used an electrostatic latent image-developing method comprising forming on the surface of a photosensitive member or an electrostatic charge-retaining member; supplying a developer obtained by blending the black toner with a magnetic carrier to a non-magnetic sleeve disposed opposite to the surface of the photosensitive member or electrostatic charge-retaining member and equipped therein with a magnetic field-generating member; and bringing the magnetic brush formed on the non-magnetic sleeve into slide-frictional contact with the photosensitive member or electrostatic charge-retaining member to develop the electrostatic latent image into visual image.

As the magnetic carrier used in the two-component developing method, there may be used known magnetic carriers. Specific examples of the magnetic carriers may include iron oxide-based carriers containing magnetite or soft ferrite (such as Ni—Zn-based ferrite, Mg—Zn-based ferrite, Cu—Zn-based ferrite, Ba—Ni—Zn-based ferrite or the like); composite carriers containing an iron powder carrier, a resin and magnetic particles; or the like.

The magnetic carrier has an average particle diameter of usually 10 to 200 $\mu$m, preferably 20 to 150 $\mu$m.

In the case where the black toner of the present invention is used in the above developing methods, it is possible to not only prevent occurrence of fogging on a background portion, but also obtain images having a high density and an excellent durability.

The image density is preferably not less than 1.10, more preferably not less than 1.20.

As to the image durability, the changing percentage of the image density is preferably not more than 10%, more preferably not more than 8%, still more preferably not more than 6%.

As to the image fogging, the $\Delta L^*$ value is preferably not more than 4.0, more preferably not more than 3.0 as measured by the below-mentioned method.

Next, the process for producing the black composite particles for the black toner according to the present invention is described.

The black composite particles according to the present invention can be produced by mixing the core particles with the gluing agent to form a gluing agent-coating layer on at least a part of the surface of the respective core particles; and then mixing the core particles coated with the gluing agent with the black pigments to form an black pigment coat on at least a part of the gluing agent-coating layer.

The formation of the gluing agent-coating layer on the surface of the core particles may be performed by mechanically mixing and stirring the core particles with the gluing agent, or by mechanically mixing and stirring the core particles and the gluing agent while spraying the gluing agent onto the core particles. A substantially whole amount of the gluing agent added can be used for coating the surface of the core particles.

Meanwhile, in the case where alkoxysilanes or fluoroalkylsilanes are used as the gluing agent, a part of the alkoxysilanes or fluoroalkylsilanes may be coated in the form of organosilane compounds obtainable from the alkoxysilanes or fluoroalkyl organosilane compounds obtainable form fluoroalkylsilanes through the coating step. Even in such a case, subsequent adhesion of the black pigment on the gluing agent-coating layer is not adversely affected.

In order to uniformly coat the gluing agent over the surface of the core particles, it is preferred that the agglomerated core particles are previously deaggregated using a crusher.

The mixing and stirring of the core particles with the gluing agent, the mixing and stirring of the black pigment with the gluing agent-coated core particles, is preferably carried out using an apparatus capable of applying a shear force to the powder mixture, especially such an apparatus capable of simultaneously effecting shear action, spatula stroking and compression. Examples of such apparatuses may include wheel-type kneaders, ball-type kneaders, blade-type kneaders, roll-type kneaders or the like. Among these apparatuses, the wheel-type kneaders are preferred to effectively practice the present invention.

Specific examples of the wheel-type kneaders may include edge runners (similar in meaning to mix muller, Simpson mill and sand mill), multi mill, Stotz mill, Wet pan mill, corner mill, ring muller or the like. Among these kneaders, preferred are edge runners, multi mill, Stotz mill, Wet pan mill and ring muller, and more preferred are edge runners. Specific examples of the ball-type kneaders may include vibration mill or the like. Specific examples of the blade-type kneaders may include Henschel mixer, planetary mixer, Nauter mixer or the like. Specific examples of the roll-type kneaders may include extruders or the like.

The conditions of the mixing and stirring treatment may be selected so as to uniformly coat the surface of the particle with the gluing agent. Specifically, the mixing and stirring conditions may be appropriately controlled such that the linear load is usually 19.6 to 1,960 N/cm (2 to 200 Kg/cm), preferably 98 to 1,470 N/cm (10 to 150 Kg/cm), more preferably 147 to 980 N/cm (15 to 100 Kg/cm); the treating time is usually 5 minutes to 24 hours, preferably 10 minutes to 20 hours; and the stirring speed is usually 2 to 2,000 rpm, preferably 5 to 1,000 rpm, more preferably 10 to 800 rpm.

The amount of the gluing agent added is preferably 0.15 to 45 parts by weight based on 100 parts by weight of the core particles. When the gluing agent is added in an amount of 0.15 to 45 parts by weight, it is possible to adhere 1 to 500 parts by weight of the black pigment onto 100 parts by weight of the core particles.

After the surface of the core particle is coated with the gluing agent, the black pigment is added, and then mixed and stirred with the coated core to adhere the black pigment onto the gluing agent-coating layer. The obtained particles may be further subjected to drying or heating treatments, if required.

As the adding method, a continuous addition method and a divided addition method may be exemplified. In case of continuously adding the black pigments, the black pigment may be added slowly and little by little, especially for a period of 5 minutes to 24 hours, preferably 5 minutes to 20 hours. In case of dividedly adding the black pigments, the adding step of the black pigments of 5 to 25 parts by weight based on 100 parts by weight of the core particles, and mixing and stirring step under the following conditions can be repeated until the added amount of the black pigments reaches a predetermined amount thereof.

The mixing and stirring conditions may be appropriately selected so as to form a uniform black pigment coat on the gluing agent-coating layer, and may be controlled such that the linear load is usually 19.6 to 1,960 N/cm (2 to 200 Kg/cm), preferably 98 to 1,470 N/cm (10 to 150K/cm), more preferably 147 to 980 N/cm (15 to 100 Kg/cm); the treating time is usually 5 minutes to 24 hours, preferably 10 minutes to 20 hours; and the stirring speed is usually 2 to 2,000 rpm, preferably 5 to 1,000 rpm, more preferably 10 to 800 rpm.

The amount of the black pigments added is usually 1 to 500 parts by weight, preferably 5 to 400 parts by weight, more preferably 30 to 400 parts by weight, still more preferably 50 to 300 parts by weight based on 100 parts by weight of the core particles. When the amount of the black pigments added is out of the above-specified range, it may be difficult to obtain the aimed black composite particles.

The heating temperature used in the drying and heating treatments is preferably 40 to 150° C., more preferably 60 to 120° C., and the heating time is preferably 10 minutes to 12 hours, more preferably 30 minutes to 3 hours.

Meanwhile, in the case where alkoxysilanes or fluoroalkylsilanes are used as the gluing agent, a coating layer composed of organosilane compounds obtainable from the alkoxysilanes or fluorine-containing organosilane compounds obtainable from the fluoroalkylsilanes is finally formed on the surface of the core particles when treated through these steps.

In the production of the black composite particles according to the present invention, the black pigments added are finely divided and adhered in the form of a uniform and dense adhesion coat on the surface of the extender pigments as the core particles through the gluing agent when treated through the above steps.

The extender pigment as the core particles may be previously coated, if required, with at least one compound selected from the group consisting of hydroxides of aluminum, oxides of aluminum, hydroxides of silicon and oxides of silicon, prior to mixing and stirring with the gluing agent.

The formation of the intermediate coat is conducted as follows. That is, an aluminum compound, a silicon compound or both the aluminum and silicon compounds are added to a water suspension prepared by dispersing the core particles in water. The resultant mixture is mixed and stirred together and then, if required, the pH value thereof is adjusted adequately, thereby forming the intermediate coat, on the surface of the core particle. Thereafter, the thus-obtained core particles coated with at least one compound selected from the group consisting of hydroxides of aluminum, oxides of aluminum, hydroxides of silicon and oxides of silicon, are filtered out, washed with water, dried and then pulverized, and may be further subjected to subsequent treatments such as deaeration and compaction, if required.

Examples of the aluminum compound may include aluminum salts such as aluminum acetate, aluminum sulfate, aluminum chloride and aluminum nitrate, alkali aluminates such as sodium aluminate, or the like.

Examples of the silicon compound may include water glass #3, sodium orthosilicate, sodium metasilicate or the like.

Next, the process for producing the black toner according to the present invention is described.

The black toner of the present invention can be produced by an ordinary method, i.e., by blending a predetermined amount of the binder resin and a predetermined amount of the black composite particles with each other, and then subjecting the resultant mixture to kneading and pulverization. More specifically, the black composite particles and the binder resin are charged, if required, together with a mold-releasing agent, a charge controller and other additives into a mixing apparatus, and intimately mixed together therein. The resultant mixture was kneaded by a heating kneader to disperse the black composite particles in the binder resin, and then cooled and solidified, thereby obtaining a kneaded resin material. Then, the kneaded resin material is pulverized and classified to obtain particles having the aimed particle size.

As the mixing apparatus, there may be used a Henschel mixer, a ball mill or the like. As the heating kneader, there may be used a roll mill, a kneader, a twin-screw extruder or the like. Also, the pulverization may be conducted using any suitable pulverizer such as a cutter mill and a jet mill. The classification may be conducted by a known method such as air classification as described in Japanese Patent No. 2,683,142, etc.

The black toner may also be produced by other methods such as a suspension polymerization method and an emulsion polymerization method. In the suspension polymerization method, the polymerizable monomer and the black composite particles are mixed, if required, together with a polymerization initiator, a cross-linking agent, a charge controller and other additives, and the resultant mixture is dissolved and dispersed to obtain a monomer composition. The thus obtained monomer composition is then added to a water phase containing a suspension stabilizer while stirring, granulated and then polymerized, thereby obtaining a black toner having the aimed particle size.

Also, in the emulsion polymerization method, the monomer and the black composite particles are dispersed in water, if required, together with a polymerization initiator or the like, and then polymerized by adding an emulsifier thereto, thereby obtaining a black toner having the aimed particle size.

The point of the present invention is that the black composite particles comprising extender pigments as core particles, a gluing agent-coating layer formed on the surface of the respective core particles, and a black pigment coat composed of finely divided black pigments and uniformly formed on the gluing agent-coating layer, can exhibit not only excellent blackness, fluidity and light resistance, but also an excellent dispersibility in the binder resin.

The reason why the black toner of the present invention can exhibit an excellent blackness, is considered as follows. That is, in the case of the black composite particles contained in the black toner of the present invention, since the extender pigment of the black composite particles are selected from the extender pigments having a low hiding power, the black pigments adhered thereon can exhibit an inherent hue without being vanished by the hue of the extender pigments.

Further, the reason why the black toner of the present invention can exhibit an excellent fluidity, is considered as follow. That is, in the case of the black composite particles contained in the black toner of the present invention, since the extender pigments as core particles have an excellent fluidity such as fine silica particles which are usually used as external additives for improving the fluidity of toners, the black composite particles can exhibit an excellent fluidity. In addition, since the black composite particles are uniformly dispersed inside and outside the binder resin, adequate irregularities are formed on the respective toner particles, so that the obtained black toner can be enhanced in fluidity.

The reason why the black composite particles contained in the black toner of the present invention can exhibit an excellent dispersibility in toner, is considered as follows. That is, in the case of the black composite particles of the present invention, the amount of the black pigments desorbed from the surface of the extender pigment is very small and as a result, the black composite particles can be well dispersed in the binder resin without disturbance by the desorbed black pigments. In addition, since the compatibility between the black composite particles and the binder resin is enhanced by forming the gluing agent-coating layer on the surface of the extender pigment and further forming the black pigment coat onto the gluing agent-coating layer, the black composite particles can be further improved in dispersibility in the binder resin.

In addition, the reason why not only a less image fogging but also high image density and image durability can be attained by the developing method of the present invention, is considered to be that the black composite particles can be uniformly dispersed in the black toner used.

Namely, since the black pigments are fixedly bonded onto the surface of the core particles through the gluing agent-coating layer, the amount of the black pigments desorbed from the surface of the black composite particles is considerably reduced, so that the black composite particles can be dispersed in the binder resin without being disturbed by the desorbed black pigments. Further, since the compatibility between the black composite particles and the binder resin is enhanced by forming a gluing agent-coating layer on the surface of the core particles and adhering the black pigments onto the gluing agent-coating layer, the dispersibility of the black composite particles in the binder resin can be improved, so that it becomes possible to obtain a black toner in which the black composite particles is uniformly dispersed.

The black composite particles of the present invention can exhibit not only excellent blackness, fluidity and light resistance, but also an excellent dispersibility in the binder resin upon the production of toner and, therefore, are suitable as black composite particles for black toner.

The black toner of the present invention is produced by using the black composite particles having excellent blackness, fluidity and light resistance and, therefore, is suitable as a black toner exhibiting excellent blackness, fluidity and light resistance.

EXAMPLES

The present invention is described in more detail by Examples and Comparative Examples, but the Examples are only illustrative and, therefore, not intended to limit the scope of the present invention thereto.

Various properties were measured by the following methods.

(1) The average particle diameter of the particles was expressed by the average value of measured particle diameters of 350 particles observed on an electron micrograph (×50,000).

(2) The sphericity of the particles was expressed by the ratio of the average particle diameter (average maximum diameter) to the average minimum diameter.

(3) The specific surface area was expressed by the value measured by a BET method.

(4) The specific gravity of the particles was measured using a "Multi-Volume Densitometer 1305-Model" manufactured by Micro-Meritix Co., Ltd.

(5) The amounts of Al and Si existing on the surface of the extender pigments coated with the intermediate coat, and the amount of Mn contained in Mn-containing hematite particles as the below-mentioned core particles 6, were measured by a fluorescent X-ray analyzing apparatus "3036M-Model" (manufactured by RIGAKU DENKI KOGYO CO., LTD.) according to "General Rule for Fluorescent X-ray Analysis" prescribed in JIS K0119.

(6) The amounts of the gluing agent-coating layer formed on the surface of the extender pigments, and the black pigment coat formed on the gluing agent-coating layer were respectively determined by measuring the carbon contents using "Horiba Metal, Carbon and Sulfur Analyzer EMIA-2200 Model" (manufactured by HORIBA SEISAKUSHO CO., LTD.).

(7) The fluidity of each of the extender pigments, the black composite particles and the black toner was expressed by the fluidity index as a sum of indices obtained by measuring respective particle characteristics, i.e., an angle of repose (°), a compaction degree (%), a spatula angle (°) and an agglomeration degree of the particles, and replacing the measured values with numerals based on the same standard. The closer to 100 the fluidity index, the more excellent the fluidity.

(8) The hue of the extender pigments and the blackness of each of the black pigments and the black composite particles, were measured by the following method.

That is, 0.5 g of each sample and 0.5 ml of castor oil were intimately kneaded together by a Hoover's muller to form a paste. 4.5 g of clear lacquer was added to the obtained paste and was intimately kneaded to form a paint. The obtained paint was applied on a cast-coated paper by using a 150 μm (6-mil) applicator to produce a coating film piece (having a film thickness of about 30 μm). The thus obtained coating film piece was measured by a Multi-Spectro-Colour-Meter "MSC-IS-2D" (manufactured by SUGA SHIKENKI CO., LTD.) to determine color specification values (L*, a* and b* values) according to JIS Z 8729. The hue of the extender pigments was expressed by the L*, a* and b* values and the blackness of each of the black pigments and the black composite particles was expressed by the L* value. Here, the L* value represents a brightness, and the smaller the L* value, the more excellent the blackness. Meanwhile, the C* value representing chroma is calculated according to the following formula:

$$C^*=((a^*)^2+(b^*)^2)^{1/2}$$

(9) The tinting strength of the black composite particles was measured by the following method.

That is, a primary color enamel and a vehicle enamel prepared by the below-mentioned method were respectively applied on a cast-coated paper by a 150 μm (6-mil) applicator to produce coating film pieces. The thus obtained coating film pieces were measured by a multi-spectro-colour-meter "MSC-IS-2D" (manufactured by SUGA TESTING MACHINES MANUFACTURING CO., LTD.) to determine L* values thereof. The difference between the obtained L* values was represented by a ΔL* value.

Next, as a standard sample for the black composite particles, a mixed pigment was prepared by simply mixing the black pigment and the extender pigments at the same mixing ratio as used for the production of the black composite particles. Using the thus prepared mixed pigment as standard sample, the same procedure as defined above was conducted to prepare an primary color enamel and a vehicle enamel, form coating film pieces and measure L* values thereof. The difference between the L* values was represented by a ΔLs* value.

From the obtained ΔL* value of the black composite particles and ΔLs* value of the standard sample, the tinting strength (%) was calculated according to the following formula:

$$\text{Tinting strength } (\%)=100+\{(\Delta Ls^*-\Delta L^*)\times 10\}$$

Preparation of Primary Color Enamel:

10 g of the above sample particles, 16 g of an amino alkyd resin and 6 g of a thinner were blended together. The resultant mixture was added together with 90 g of 3 mmϕ glass beads into a 140-ml glass bottle, and then mixed and dispersed for 45 minutes by a paint shaker. The obtained mixture was mixed with 50 g of an amino alkyd resin, and further dispersed for 5 minutes by a paint shaker, thereby obtaining an primary color enamel.

Preparation of Vehicle Enamel:

12 g of the above-prepared primary color enamel and 40 g of Aramic White (titanium dioxide-dispersed amino alkyd resin) were blended together, and the resultant mixture was mixed and dispersed for 15 minutes by a paint shaker, thereby preparing a vehicle enamel.

(10) The light resistance of each of the black composite particles was measured by the following method.

That is, the primary color enamel as prepared above was applied onto a cold-rolled steel plate (0.8 mm×70 mm×150 mm; JIS G-3141) and dried to form a coating film having a thickness of 150 μm. One half of the thus prepared test specimen was covered with a metal foil, and an ultraviolet light was continuously irradiated over the test specimen at an intensity of 100 mW/cm$^2$ for 6 hours using "EYE SUPER UV TESTER SUV-W13" (manufactured by IWASAKI DENKI CO., LTD.). Then, the hues (L*, a* and b* values) of the UV-irradiated portion and the metal foil-covered non-irradiated portion of the test specimen were respectively measured using a Multi-Spectro-Colour-Meter "MSC-IS-2D" (manufactured by SUGA SHIKENKI CO., LTD.). The ΔE* value was calculated from differences between the measured hue values of the metal foil-covered non-irradiated portion and the UV-irradiated portion according to the following formula:

$$\Delta E^*=[(\Delta L^*)^2+(\Delta a^*)^2+(\Delta b^*)^2]^{1/2}$$

wherein ΔL* represents the difference between L* values of the non-irradiated and UV-irradiated portions; Δa* represents the difference between a* values of the non-irradiated and UV-irradiated portions; and Δb* represents the difference between b* values of the non-irradiated and UV-irradiated portions.

(11) The degree of desorption of the black pigments from the black composite particles was visually observed and evaluated by the following method, and the observation results were classified into the following five ranks. The rank 5 represents that the amount of the black pigments desorbed from the black composite particles was smallest.

That is, 2 g of the particles to be measured and 20 ml of ethanol were placed in a 50-ml conical flask and then were subjected to ultrasonic dispersion for 60 minutes. Thereafter, the obtained dispersion was centrifuged at a rotating speed of 10,000 rpm for 15 minutes to separate the particles from the solvent. The obtained particles were dried at 80° C. for one hour, and the micrograph (×50,000) thereof was visually observed to count the number of the desorbed and re-aggregated black pigment particles present in visual field of the micrograph. The micrograph was compared with a micrograph (×50,000) of mixed particles obtained by simply mixing the core particles with the black pigments without forming the gluing agent-coating layer. The results are classified into the following five ranks.

Rank 1: Number of desorbed and re-aggregated particles was substantially the same as that in the simply mixed particles;

Rank 2: 30 to 49 desorbed and re-aggregated particles per 100 core particles were recognized;

Rank 3: 10 to 29 desorbed and re-aggregated particles per 100 core particles were recognized;

Rank 4: 5 to 9 desorbed and re-aggregated particles per 100 core particles were recognized; and Rank 5: 0 to 4 desorbed and re-aggregated particles per 100 core particles were recognized.

(12) The dispersibility of the black composite particles in binder resin was evaluated by counting the number of undispersed aggregate particles observed on a micrograph (×200) of a section of the black toner particles which was obtained using an optical microscope "BH-2" manufactured by Olympus Kogaku Kogyo Co., Ltd., and classifying the results into the following five ranks. The rank 5 represents the most excellent dispersing condition.

Rank 5: No undispersed aggregate particles were recognized.

Rank 4: 1 to 4 undispersed aggregate particles per 0.25 mm$^2$ were recognized;

Rank 3: 5 to 9 undispersed aggregate particles per 0.25 mm2 were recognized;

Rank 2: 10 to 49 undispersed aggregate particles per 0.25 mm$^2$ were recognized;

Rank 1: Not less than 50 undispersed aggregate particles per 0.25 mm$^2$ were recognized.

(13) The volume resistivity value of black toner was determined by measuring the electric resistance value of the samples prepared by the following method.

0.5 g of sample particles thereof were weighed, and pressure-molded under a pressure of 1.372×10$^7$ Pa (140 Kg/cm$^2$) by a KBr tableting machine (manufactured by SHIMADZU SEISAKUSHO CO., LTD.), thereby preparing a cylindrical test specimen.

Next, the thus prepared test specimen was exposed to the environmental condition at a temperature of 25° C. and a relative humidity of 60% for not less than 12 hours, and then set between a pair of stainless steel electrodes. The test specimen was applied with a voltage of 15 V by using a Wheastone bridge ("TYPE 2768" manufactured by Yokogawa Hokushin Denki Co., Ltd.) to measure an electric resistance value R (Ω) thereof.

Then, a top surface area A (cm$^2$) and a thickness $t_0$ (cm) of the cylindrical test specimen were measured, and the volume resistivity value (Ω·cm) thereof was calculated by inserting the measured values into the following formula:

$$\text{Volume Resistivity Value } (\Omega\cdot\text{cm})=R\times(A/t_0)$$

(14) The average particle diameter of the black toner was measured by a laser diffraction-type particle size distribution measuring device "Model HELOS LA/KA" manufactured by SYMPATEC Co., Ltd.

(15) The image density was expressed by the average value of image densities measured at five points of the image printed out on a CLC paper of A4 size (80 g/m$^2$; produced by Canon Co., Ltd.) using a Macbeth reflection densitometer (produced by Macbeth Co., Ltd.).

(16) The image durability was expressed by the value obtained by measuring image densities at five points of the image printed out on a CLC paper of A4 size (80 g/m$^2$; produced by Canon Co., Ltd.) as the 5,000th print-out using a Macbeth reflection densitometer (produced by Macbeth Co., Ltd.), calculating respective average values of the measured image densities, and substituting the thus calculated average values for Ca and Ce of the following formula:

$$\text{Image Durability } (\%)=\{(Ca-Ce)/Ca\}\times 100$$

wherein Ca represents the average value of initial image densities; and Ce represents the average value of image densities obtained on the 5,000th print-out.

(17) The image fogging was determined as follows. That is, after repeatedly printing out the image on 5,000 CLC papers of A4 size (80 g/m$^2$; produced by Canon Co., Ltd.), the whiteness L* value of the white image formed on the 5,000th paper using the respective black toner was measured by a multi-spectro-colour-meter "MSC-IS-2D" (manufactured by SUGA TESTING MACHINES MANUFACTURING CO., LTD.), thereby determining the fogging on the paper. The image fogging was expressed by the ΔL* value obtained by subtracting the whiteness (L* value) of a non-image-forming portion of the 5,000th print-out from the whiteness (L* value) of a non-printed paper. The smaller the ΔL* value, the less the image fogging.

Example 1

Production of Black Composite Particles 280 g of methyl hydrogen polysiloxane (tradename: "TSF484", produced by GE TOSHIBA SILICONE CO., LTD.) was added to 7.0 kg of silica particles as shown in the micrograph (×50,000) of FIG. 1 (particle shape: spherical shape; average particle diameter: 0.022 μm; sphericity: 1.06; BET specific surface area value: 193.8 m$^2$/g; specific gravity: 2.32; fluidity index: 55; L* value: 92.4; a* value: 0.2; b* value: 0.4; C* value: 0.4; hiding power: 10 cm$^2$/g) while operating an edge runner, and the resultant mixture was mixed and stirred for 45 minutes under a linear load of 588 N/cm (60 Kg/cm) at a stirring speed of 22 rpm.

Figure 2:
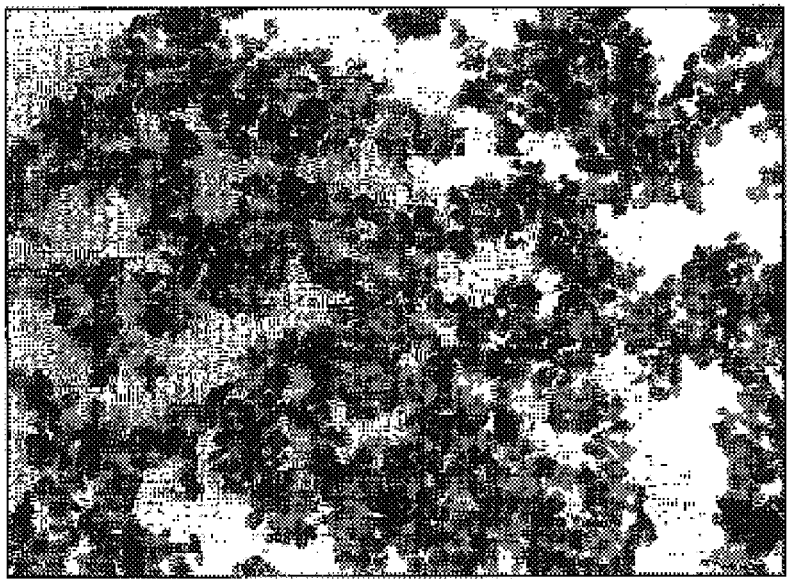
FIG. 2 is a micrograph (×50,000) of black pigments used in Example 1.

Then, 7.0 kg of black pigments as shown in the micrograph (×50,000) of FIG. 2 (kind: carbon black (furnace black); particle shape: granular shape; average particle diameter: 0.022 μm; BET specific surface area value: 133.5 m$^2$/g; specific gravity: 1.84; L* value: 14.6) were added to the above-obtained mixture for 40 minutes while operating the edge runner, and the resultant mixture was mixed and stirred for 90 minutes under a linear load of 588 N/cm (60 Kg/cm) at a stirring speed of 22 rpm, thereby adhering the carbon black onto the methyl hydrogen polysiloxane coating layer formed on the respective silica particles. The obtained particles were dried at 80° C. for 60 minutes using a dryer, thereby obtaining a black composite particles.

The thus obtained black composite particles was in the form of granular particles having an average particle diameter of 0.026 μm and a sphericity of 1.06, and had a BET specific surface area value of 123.3 m$^2$/g; a specific gravity of 2.06; fluidity index: 72; a blackness (L* value) of 16.5; a tinting strength of 138%; a light resistance (ΔE* value) of 1.1; and a black pigment desorption degree of Rank 5; and a coating amount of methyl hydrogen polysiloxane of 1.09% by weight (calculated as C). Further, it was confirmed that the amount of the carbon black adhered was 48.62% by weight (calculated as C; corresponding to 100 parts by weight based on 100 parts by weight of the silica particles).

Figure 3:
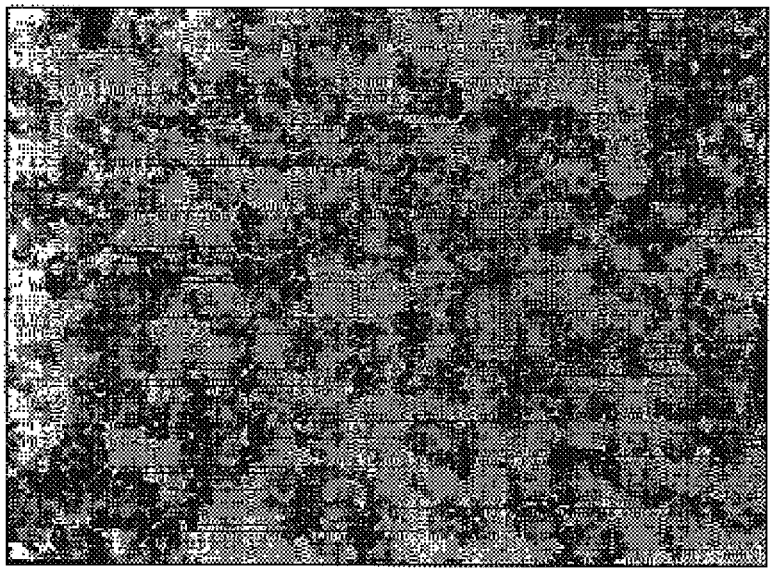
FIG. 3 is a micrograph (×50,000) of black composite particles obtained in Example 1.

As a result of observing the micrograph (×50,000) of the obtained black composite particles as shown in FIG. 3, since almost no black pigments were recognized from the micrograph, it was confirmed that a substantially whole amount of the black pigments used contributed to the formation of the black pigment coat on the coating layer composed of methyl hydrogen polysiloxane. Further, it was recognized that the black pigments adhered no longer maintained the particle shape and size of those initially added, more specifically, the black pigments had a much finer particle size than that of the core particles and were adhered onto the surface of the extender pigments in the form of a uniform adhesion coat.

Figure 4:
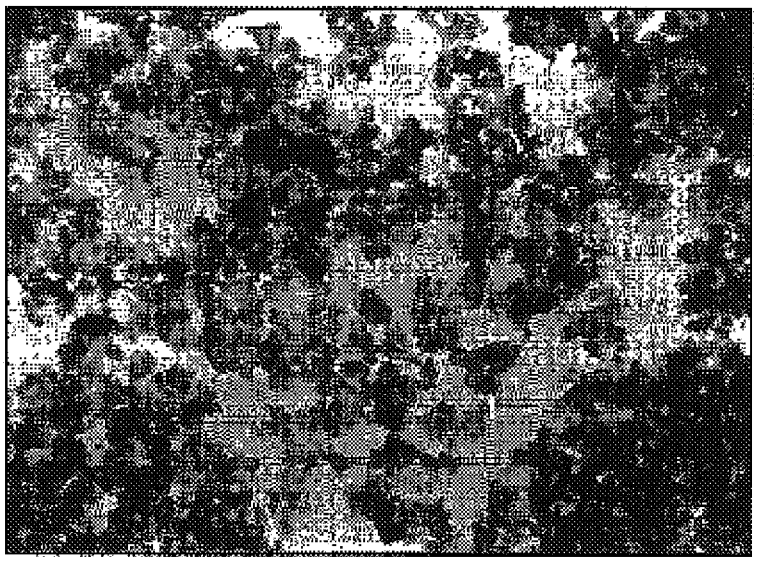
FIG. 4 is a micrograph (×50,000) of a simple mixture of silica particles and black pigments used in Example 1.
Figure 5:
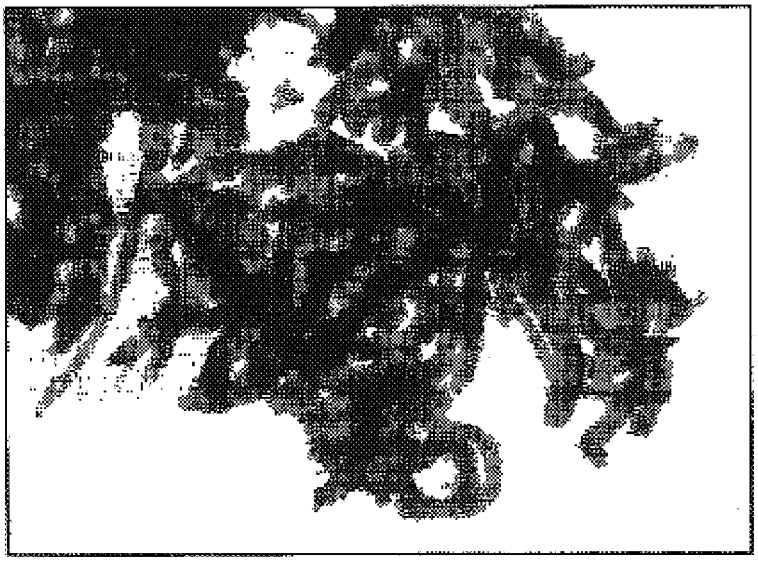
FIG. 5 is a micrograph (×50,000) of black pigments C used in Example 16.
Figure 6:
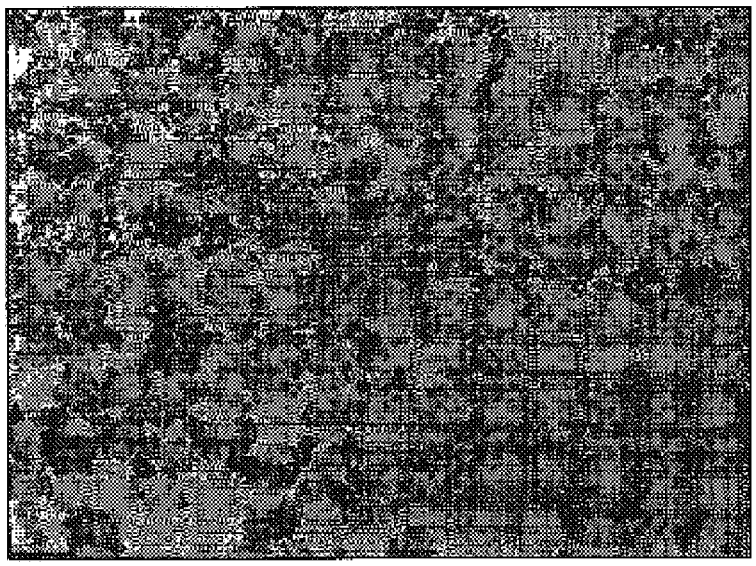
FIG. 6 is a micrograph (×50,000) of black composite particles obtained in Example 16.
Figure 7:
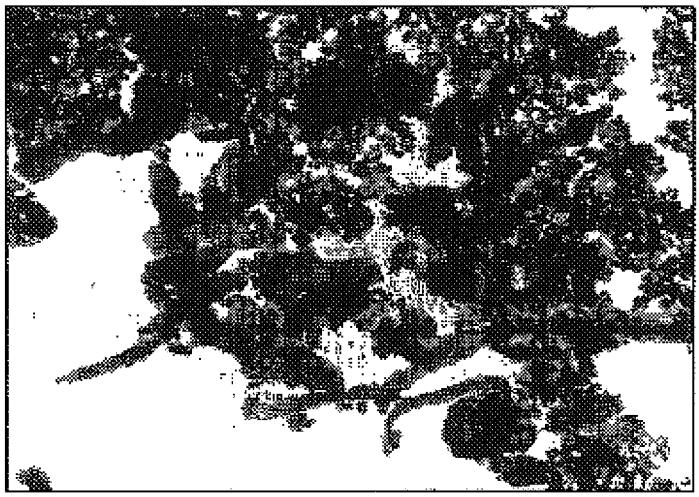
FIG. 7 is a micrograph (×50,000) of a simple mixture of silica particles used in Example 1 and black pigments C used in Example 16 for comparison.

On the other hand, the extender pigments and the black pigments were simply mixed with each other by the same method as defined above except that no gluing agent was used. The micrograph (×50,000) of the thus obtained simply mixed particles is shown in FIG. 4. As is apparent from the micrograph of FIG. 4, in the case where the black pigments and the silica particles were simply mixed with each other without using the gluing agent, it was confirmed that the black pigments were not reduced in particle size, and both the particles were dispersed separately and independently from each other, thereby failing to form a uniform and dense black pigment coat adhered onto the surface of the extender pigments.

Example 2

Production of Black Toner 150 g of the black composite particles obtained in Example 1, 765 g of a styrene-butyl acrylate-methyl methacrylate copolymer resin (molecular weight: 130,000; styrene/butyl acrylate/methyl methacrylate=82.0/16.5/1.5), 70 g of a polypropylene wax (molecular weight: 3,000) and 15 g of a charge controller were charged into a Henschel mixer, and mixed and stirred at a vessel temperature of 60° C. for 15 minutes. The obtained mixed particles were melt-kneaded in a continuous-type twin-screw kneader at 140° C. The obtained kneaded material was cooled in air, coarsely pulverized, finely pulverized and then classified, thereby obtaining a black toner.

The thus obtained black toner had an average particle diameter of 8.9 μm; a dispersibility of Rank 5; and a fluidity index of 91; a blackness of 17.0 and a volume resistivity value $7.7\times10^{13}$ Ω·cm.

Example 3

Black Toner A

The black composite particles obtained in Example 1, a polyester resin, a polypropylene wax and a charge controller were charged at the following mixing ratio into a Henschel mixer, and mixed and stirred at a vessel temperature of 60° C. for 15 minutes. The obtained mixed particles were melt-kneaded in a continuous-type twin-screw kneader at 140° C. The obtained kneaded material was cooled in air, coarsely pulverized, finely pulverized and then classified, thereby obtaining a magnetic black toner.

Composition of Mixed Particles:

| | |
|---|---|
| Black composite particles | 10.0 parts by weight |
| Polyester resin | 85.0 parts by weight |
| Polypropylene wax | 10.0 parts by weight |
| Charge controller | 1.0 part by weight |

The thus obtained black toner A had an average particle diameter of 9.0 μm; a dispersibility of Rank 5; and a fluidity index of 92; blackness of 17.0 and a volume resistivity value of $8.4\times10^{13}$ Ω·cm.

Example 4

Developing Method 1: Two-component System Developing Method

The above black toner A obtained in Example 3 was mixed with a ferrite carrier to prepare developers. The images were formed by the following method using these developers, and evaluated. That is, an electrostatic latent image was formed on a photosensitive member, and the developers were supplied to a non-magnetic sleeve disposed opposite to the photosensitive member and equipped therein with a magnetic field-generating member to form a magnetic brush thereon. The magnetic brush was brought into slide-frictional contact with the photosensitive member to develop the electrostatic latent image.

The image produced using the black toner A had an image density of 1.59; an image durability of 3.7%; and an image fogging (ΔL* value) of 1.49.

Example 5

Developing Method 2: One-component System Developing Method

The above black toner A obtained in Example 3 was used as developers, and the images were formed by the following method using these developers, and evaluated. In the image evaluation, a remodeled apparatus of Hitachi Priusu 4220 was used. First, the toner was charged into a hopper of a developing device, and adhered onto an aluminum sleeve. The amount of the toner adhered was regulated by a blade to form a thin layer of the developer on the sleeve. After the developing device was mounted in a printer, the surface potential of the photosensitive member and the bias voltage of the developing device were set to −600 V and −450V, respectively, thereby adhering the toner onto the electrostatic latent image. The obtained toner image was transferred to a transfer drum, and further transferred onto a paper, thereby obtaining a printed image.

The image produced using the black toner A had an image density of 1.56; an image durability of 4.1%; and an image fogging (ΔL* value) of 1.56.

Core Particles 1 to 6:

Core particles 1 to 6 having properties shown in Table 1 were prepared.

Core Particles 7:

A slurry containing silica particles was obtained by dispersing 20 kg of silica particles (core particles 1) in 150 liters of water. The pH value of the thus obtained slurry containing the silica particles was adjusted to 10.5, and then the slurry concentration was adjusted to 98 g/liter by adding water thereto. After 150 liters of the slurry was heated to 60° C., 2,722 ml of a 1.0 mol/liter $NaAlO_2$ solution (corresponding to 0.5% by weight (calculated as Al) based on the weight of the silica particles) was added to the slurry. After allowing the obtained slurry to stand for 30 minutes, the pH value of the slurry was adjusted to 7.5 by using acetic acid. After further allowing the resultant slurry to stand for 30 minutes, the slurry was subjected to filtration, washing with water, drying and pulverization, thereby obtaining the silica particles whose surface was coated with hydroxides of aluminum.

Various properties of the obtained silica particles coated with the hydroxides of aluminum are shown in Table 3.

Core Particles 8 to 11:

The same procedure as defined for the production of the above core particles 7, was conducted except that kinds of core particles, and kinds and amounts of additives added in the surface-treating step were changed variously, thereby obtaining surface-treated core particles.

The essential treatment conditions are shown in Table 2, and various properties of the obtained surface-treated core particles are shown in Table 3.

Meanwhile, in Tables, "A" and "S" as described in "kind of coating material used in surface-treating step" represent hydroxides of aluminum and oxides of silicon, respectively.

Black Pigments A to C:

Black pigments A to C having properties as shown in Table 4 were prepared.

Examples 6 to 16

Comparative Examples 1 to 5

The same procedure as defined in Example 1 was conducted except that kinds of core particles, kinds and amounts of gluing agents added in coating step with gluing agent, linear load and treating time for edge runner treatment used in the coating step with gluing agent, kinds and amounts of black pigments adhered in black pigment-adhering step, and linear load and treating time for edge runner treatment used in the black pigment-adhering step, were changed variously, thereby obtaining black composite particles.

The essential production conditions are shown in Tables 5 and 6, and various properties of the obtained black composite particles are shown in Tables 7 and 8.

Comparative Example 6 (Follow-Up Test of Example 1 of Japanese Patent No. 3097208)

The silica particles (core particles 1) were dispersed in distilled water at the below-mentioned blending ratio. A silane-based coupling agent (γ-aminopropyl triethoxysilane) was gradually added to the obtained dispersion. After completion of addition of the silane-based coupling agent, the dispersion was allowed to stand at 50° C. for several hours until the reaction between the silica particles and the silane-based coupling agent was completed. Meanwhile, the termination of the reaction between the silica particles and the silane-based coupling agent was determined using FT-IR "MAGNA-IR" (manufactured by Nicolett Co., Ltd.). The resultant dispersion was transferred into an attritor, and the black pigments A (carbon black) were added to the dispersion. The resultant mixture was dispersed for 12 hours to conduct the reaction between the silane-based coupling agent and the black pigments A.

Dispersion Composition:

| | |
|---|---|
| Silica particles | 10.0 parts by weight |
| Distilled water | 84.3 parts by weight |
| Silane-based coupling agent | 0.2 part by weight |
| Black pigments A | 5.0 parts by weight |

Various properties of the thus obtained colored silica particles are shown in Table 8.

Comparative Example 7 (Follow-Up Test of Examples of Japanese Patent No. 3105511)

9.6 g of the silica particles (core particles 1) were placed in a 500-ml round bottom flask equipped with a magnetic stirrer and a Dean-Stark trap, and dried therein at 100° C. for 24 hours. 300 ml of toluene previously dried by azeotropic distillation under a nitrogen atmosphere, and 2.96 g of a silane-based coupling agent (γ-aminopropyl triethoxysilane) were added to the dried silica particles. The obtained suspension was refluxed at 111° C. for 5 hours, cooled to room temperature, and then centrifuged at a rotating speed of about 10,000 rpm. After removing a supernatant from the suspension, the resultant precipitate was washed with 500 ml of dichloromethane, and successively the mixture of the precipitate and dichloromethane was centrifuged. After a supernatant was removed from the mixture, the obtained residues were dried at 40° C. for 2.5 days in a vacuum dryer (200 mmHg), thereby obtaining 9.6 g of white particles (yield: 76%).

Next, an aqueous mixture prepared by dispersing 1.0 g of the above silica particles containing the silane-based coupling agent and 1.0 g of Naphthol Blue Black in 40 ml of water, was placed in a round bottom flask equipped with a magnetic stirrer, stirred therein at room temperature for 18 hours, and then centrifuged. The resultant residues were dispersed in water and then centrifuged until the supernatant became colorless. The obtained residues were re-dispersed in water, and then freeze-dried using a freeze dryer, thereby 0.75 g of colored silica particles.

Various properties of the obtained colored silica particles are shown in Table 8.

Examples 17 to 27

Comparative Examples 8 to 17

The same procedure for the production of black toner as defined in Example 2 was conducted except that kinds of black composite particles were changed variously, thereby obtaining black toners.

The essential production conditions are shown in Tables 9 and 10, and various properties of the obtained black toners are shown in Tables 11 and 12.

Examples 28 to 31

Comparative Examples 18 to 19

The same procedure for black toner A as defined in Example 3 was conducted except that kinds of black composite particles were changed variously, thereby obtaining black toners.

The essential production conditions are shown in Tables 9 and 10, and various properties of the obtained black toners are shown in Tables 11 and 12.

Examples 32 to 37

Comparative Examples 20 to 23

The same procedure as defined in Example 4 or 5 was conducted except that kinds of developing methods and black toners were changed variously, thereby forming images.

The essential image-forming conditions and various properties of the obtained images are shown in Table 13.

TABLE 1

| | Properties of core particles | | |
|---|---|---|---|
| Kind of core particles | Kind | Shape | Average particle diameter (μm) |
| Core particles 1 | Silica | Spherical | 0.021 |
| Core particles 2 | Silica | Granular | 0.013 |
| Core particles 3 | Silica | Spherical | 0.048 |
| Core particles 4 | Alumina | Granular | 0.098 |
| Core particles 5 | Precipitated barium sulfate | Granular | 0.059 |
| Core particles 6 | Mn-containing hematite particles (Mn content: 12.6 wt. %) | Granular | 0.282 |

| | Properties of core particles | |
|---|---|---|
| Kind of core particles | Sphericity (–) | BET specific surface area value ($m^2/g$) |
| Core particles 1 | 1.02 | 196.2 |
| Core particles 2 | 1.28 | 256.3 |
| Core particles 3 | 1.11 | 168.4 |
| Core particles 4 | 1.31 | 41.3 |
| Core particles 5 | 1.22 | 21.3 |
| Core particles 6 | 1.36 | 3.8 |

| | Properties of core particles | |
|---|---|---|
| Kind of core particles | Specific gravity (–) | Fluidity index (–) |
| Core particles 1 | 2.19 | 58 |
| Core particles 2 | 2.43 | 53 |
| Core particles 3 | 2.11 | 57 |
| Core particles 4 | 3.65 | 41 |
| Core particles 5 | 4.15 | 40 |
| Core particles 6 | 5.01 | 31 |

| | Properties of core particles | | | | |
|---|---|---|---|---|---|
| | Hue | | | | |
| Kind of core particles | L* value (–) | a* value (–) | b* value (–) | C* value (–) | Hiding power ($cm^2/g$) |
| Core particles 1 | 93.1 | 0.1 | 0.3 | 0.3 | 6 |
| Core particles 2 | 94.0 | 0.3 | −0.1 | 0.3 | 11 |
| Core particles 3 | 95.1 | 0.4 | 0.2 | 0.4 | 10 |
| Core particles 4 | 96.3 | 0.1 | 0.2 | 0.2 | 18 |
| Core particles 5 | 91.6 | 0.3 | 1.1 | 1.1 | 13 |
| Core particles 6 | 22.8 | 5.5 | 1.3 | 5.7 | 1,680 |

TABLE 2

| | | Surface-treating step | | |
|---|---|---|---|---|
| | | Additives | | |
| Core particles | Kind of core particles | Kind | Calculated as | Amount (wt. %) |
| Core particles 7 | Core particles 1 | Sodium aluminate | Al | 0.5 |

TABLE 2-continued

| | | | | |
|---|---|---|---|---|
| Core particles 8 | Core particles 2 | Aluminum sulfate | Al | 2.0 |
| Core particles 9 | Core particles 3 | Aluminum sulfate | Al | 5.0 |
| Core particles 10 | Core particles 4 | Water glass #3 | $SiO_2$ | 0.5 |
| Core particles 11 | Core particles 5 | Sodium aluminate | Al | 2.00 |
| | | Water glass #3 | $SiO_2$ | 0.50 |

| | Surface-treating step Coating material | | |
|---|---|---|---|
| Core particles | Kind | Calculated as | Amount (wt. %) |
| Core particles 7 | A | Al | 0.49 |
| Core particles 8 | A | Al | 1.96 |
| Core particles 9 | A | Al | 4.76 |
| Core particles 10 | S | $SiO_2$ | 0.48 |
| Core particles 11 | A | Al | 1.93 |
| | S | $SiO_2$ | 0.47 |

TABLE 3

| | Properties of surface-treated core particles | | |
|---|---|---|---|
| Kind of core particles | Average particle diameter ($\mu$m) | Sphericity (–) | BET specific surface area value ($m^2/g$) |
| Core particles 7 | 0.022 | 1.02 | 186.3 |
| Core particles 8 | 0.015 | 1.28 | 211.4 |
| Core particles 9 | 0.050 | 1.11 | 129.1 |
| Core particles 10 | 0.099 | 1.31 | 40.8 |
| Core particles 11 | 0.061 | 1.22 | 21.9 |

| | Properties of surface-treated core particles | |
|---|---|---|
| Kind of core particles | Specific gravity (–) | Fluidity index (–) |
| Core particles 7 | 2.20 | 59 |
| Core particles 8 | 2.45 | 56 |
| Core particles 9 | 2.18 | 60 |
| Core particles 10 | 3.60 | 43 |
| Core particles 11 | 4.13 | 42 |

TABLE 3-continued

| | Properties of surface-treated core particles | | | | |
|---|---|---|---|---|---|
| | Hue | | | | |
| Kind of core particles | L* value (–) | a* value (–) | b* value (–) | C* value (–) | Hiding power ($cm^2/g$) |
| Core particles 7 | 93.1 | 0.1 | 0.1 | 0.1 | 6 |
| Core particles 8 | 94.1 | 0.2 | 0.1 | 0.2 | 10 |
| Core particles 9 | 94.6 | 0.2 | 0.1 | 0.2 | 11 |
| Core particles 10 | 93.8 | 0.1 | 0.3 | 0.3 | 21 |
| Core particles 11 | 91.0 | 0.4 | 0.8 | 0.9 | 14 |

TABLE 4

| | Properties of black particles | | |
|---|---|---|---|
| Black pigments | Kind | Shape | Average particle diameter ($\mu$m) |
| Black pigments A | Carbon black (furnace black) | Granular | 0.022 |
| Black pigments B | Carbon black (acetylene black) | Granular | 0.045 |
| Black pigments C | Aniline black | Granular | 0.312 |

| | Properties of black particles | | |
|---|---|---|---|
| Black pigments | BET specific surface area value ($m^2/g$) | Specific gravity (–) | Blackness (L* value) (–) |
| Black pigments A | 134.0 | 1.82 | 16.6 |
| Black pigments B | 71.2 | 1.95 | 17.1 |
| Black pigments C | 56.8 | 1.74 | 16.2 |

TABLE 5

| | | Production of black composite particles Coating step with gluing agent Additives | |
|---|---|---|---|
| Examples | Kind of core particles | Kind | Amount added (wt. part) |
| Example 6 | Core particles 1 | Methyl hydrogen polysiloxane | 3.0 |
| Example 7 | Core particles 2 | γ-aminopropyl triethoxysilane | 2.0 |
| Example 8 | Core particles 3 | Methyl triethoxysilane | 10.0 |
| Example 9 | Core particles 4 | Isopropyl triisostearoyl titanate | 5.0 |
| Example 10 | Core particles 5 | Water-soluble acrylic resin | 6.0 |

TABLE 5-continued

| | | | |
|---|---|---|---|
| Example 11 | Core particles 7 | Methyl triethoxysilane | 4.0 |
| Example 12 | Core particles 8 | Methyl hydrogen polysiloxane | 2.0 |
| Example 13 | Core particles 9 | Phenyl triethoxysilane | 3.0 |
| Example 14 | Core particles 10 | Methyl trimethoxysilane | 1.0 |
| Example 15 | Core particles 11 | Dimethyl dimethoxysilane | 3.0 |
| Example 16 | Core particles used in Example 1 | Methyl hydrogen polysiloxane | 4.0 |

| | Production of black composite particles Coating step with gluing agent | | | |
|---|---|---|---|---|
| | Edge runner treatment | | | Coating amount (calculated |
| | Linear load | | Time | as C) |
| Examples | (N/cm) | (Kg/cm) | (min) | (wt. %) |
| Example 6 | 588 | 60 | 30 | 0.78 |
| Example 7 | 588 | 60 | 60 | 0.32 |
| Example 8 | 294 | 30 | 30 | 0.60 |
| Example 9 | 441 | 45 | 20 | 3.62 |
| Example 10 | 735 | 75 | 60 | 2.96 |
| Example 11 | 588 | 60 | 90 | 0.25 |
| Example 12 | 294 | 30 | 60 | 0.52 |
| Example 13 | 588 | 60 | 45 | 1.04 |
| Example 14 | 490 | 50 | 30 | 0.09 |
| Example 15 | 735 | 75 | 45 | 0.57 |
| Example 16 | 588 | 60 | 45 | 1.07 |

| | Production of black composite particles Adhesion step with black pigments Black pigments | |
|---|---|---|
| Examples | Kind | Amount added (wt. part) |
| Example 6 | A | 50.0 |
| Example 7 | B | 100.0 |
| Example 8 | C | 100.0 |
| Example 9 | A | 100.0 |
| Example 10 | B | 100.0 |
| Example 11 | A | 100.0 |
| Example 12 | B | 50.0 |
| Example 13 | C | 150.0 |
| Example 14 | A | 30.0 |
| Example 15 | B | 50.0 |
| Example 16 | C | 100.0 |

| | Production of black composite particles Adhesion step with black pigments | | | |
|---|---|---|---|---|
| | Edge runner treatment | | | Amount adhered (calculated |
| | Linear load | | Time | as C) |
| Examples | (N/cm) | (Kg/cm) | (min) | (wt. %) |
| Example 6 | 588 | 60 | 60 | 33.12 |
| Example 7 | 588 | 60 | 60 | 48.36 |
| Example 8 | 588 | 60 | 30 | 39.95 |
| Example 9 | 588 | 60 | 90 | 49.27 |
| Example 10 | 588 | 60 | 60 | 48.58 |
| Example 11 | 588 | 60 | 120 | 48.73 |
| Example 12 | 441 | 45 | 90 | 33.09 |
| Example 13 | 735 | 75 | 20 | 48.88 |
| Example 14 | 588 | 60 | 20 | 22.11 |

TABLE 5-continued

| | | | | |
|---|---|---|---|---|
| Example 15 | 294 | 30 | 60 | 33.02 |
| Example 16 | 588 | 60 | 90 | 40.26 |

TABLE 6

| | | Production of black composite particles Coating step with gluing agent Additives | |
|---|---|---|---|
| Comparative Examples | Kind of core particles | Kind | Amount added (wt. part) |
| Comparative Example 1 | Core particles 1 | — | — |
| Comparative Example 2 | Core particles 1 | Methyl hydrogen polysiloxane | 0.005 |
| Comparative Example 3 | Core particles 1 | Methyl hydrogen polysiloxane | 3.0 |
| Comparative Example 4 | Core particles 1 | Methyl hydrogen polysiloxane | 3.0 |
| Comparative Example 5 | Core particles 6 | Methyl hydrogen polysiloxane | 3.0 |

| | Production of black composite particles Coating step with gluing agent | | | |
|---|---|---|---|---|
| | Edge runner treatment | | | Coating amount (calculated |
| Comparative | Linear load | | Time | as C) |
| Examples | (N/cm) | (Kg/cm) | (min) | (wt. %) |
| Comparative Example 1 | — | — | — | — |
| Comparative Example 2 | 588 | 60 | 30 | $1 \times 10^{-3}$ |
| Comparative Example 3 | 588 | 60 | 30 | 0.78 |
| Comparative Example 4 | 588 | 60 | 30 | 0.78 |
| Comparative Example 5 | 588 | 60 | 30 | 0.79 |

| | Production of black composite particles Adhesion step with black pigments Black pigments | |
|---|---|---|
| Comparative Examples | Kind | Amount added (wt. part) |
| Comparative Example 1 | A | 50.0 |
| Comparative Example 2 | A | 50.0 |
| Comparative Example 3 | A | 0.5 |
| Comparative Example 4 | A | 750.0 |
| Comparative Example 5 | A | 50.0 |

TABLE 6-continued

| Comparative Examples | Production of black composite particles Adhesion step with black pigments: Edge runner treatment: Linear load (N/cm) | Linear load (Kg/cm) | Time (min) | Amount adhered (calculated as C) (wt. %) |
|---|---|---|---|---|
| Comparative Example 1 | 588 | 60 | 60 | 33.18 |
| Comparative Example 2 | 588 | 60 | 60 | 33.07 |
| Comparative Example 3 | 588 | 60 | 60 | 0.44 |
| Comparative Example 4 | 588 | 60 | 60 | 87.59 |
| Comparative Example 5 | 588 | 60 | 60 | 33.13 |

TABLE 7

| Examples | Properties of black composite particles: Average particle diameter (μm) | Sphericity (–) | BET specific surface area value ($m^2/g$) |
|---|---|---|---|
| Example 6 | 0.023 | 1.02 | 150.1 |
| Example 7 | 0.018 | 1.28 | 176.4 |
| Example 8 | 0.052 | 1.12 | 100.2 |
| Example 9 | 0.100 | 1.31 | 51.6 |
| Example 10 | 0.062 | 1.22 | 35.8 |
| Example 11 | 0.026 | 1.03 | 133.2 |
| Example 12 | 0.018 | 1.28 | 186.2 |
| Example 13 | 0.055 | 1.11 | 81.2 |
| Example 14 | 0.010 | 1.31 | 46.5 |
| Example 15 | 0.062 | 1.22 | 31.1 |
| Example 16 | 0.026 | 1.06 | 109.7 |

| Examples | Properties of black composite particles: Specific gravity (–) | Fluidity (–) | Blackness (L* value) (–) |
|---|---|---|---|
| Example 6 | 2.05 | 72 | 17.9 |
| Example 7 | 2.18 | 70 | 18.8 |
| Example 8 | 1.88 | 73 | 17.1 |
| Example 9 | 2.69 | 66 | 17.3 |
| Example 10 | 2.99 | 64 | 19.2 |
| Example 11 | 1.99 | 75 | 17.1 |
| Example 12 | 2.27 | 73 | 19.4 |
| Example 13 | 1.91 | 76 | 16.8 |
| Example 14 | 3.17 | 67 | 21.1 |
| Example 15 | 3.36 | 65 | 20.4 |
| Example 16 | 2.01 | 71 | 16.9 |

| Examples | Properties of black composite particles: Tinting strength (%) | Light resistance (ΔE* value) (–) | Degree of desorption of black pigments (–) |
|---|---|---|---|
| Example 6 | 127 | 1.8 | 5 |
| Example 7 | 135 | 1.3 | 5 |
| Example 8 | 121 | 2.0 | 5 |
| Example 9 | 136 | 1.4 | 4 |
| Example 10 | 134 | 1.4 | 4 |
| Example 11 | 138 | 1.0 | 5 |
| Example 12 | 129 | 1.6 | 5 |
| Example 13 | 124 | 1.5 | 5 |

TABLE 7-continued

| | | | |
|---|---|---|---|
| Example 14 | 127 | 1.3 | 5 |
| Example 15 | 127 | 1.2 | 5 |
| Example 16 | 122 | 1.9 | 5 |

TABLE 8

| Comparative Examples | Properties of black composite particles: Average particle diameter (μm) | Sphericity (–) | BET specific surface area value ($m^2/g$) |
|---|---|---|---|
| Comparative Example 1 | 0.022 | 1.06 | 172.3 |
| Comparative Example 2 | 0.022 | 1.05 | 160.5 |
| Comparative Example 3 | 0.021 | 1.02 | 189.2 |
| Comparative Example 4 | 0.032 | 1.08 | 140.9 |
| Comparative Example 5 | 0.283 | 1.40 | 14.3 |
| Comparative Example 6 | 0.021 | 1.02 | 163.8 |
| Comparative Example 7 | 0.021 | 1.02 | 180.1 |

| Comparative Examples | Properties of black composite particles: Specific gravity (–) | Fluidity (–) | Blackness (L* value) (–) |
|---|---|---|---|
| Comparative Example 1 | 2.07 | 50 | 23.0 |
| Comparative Example 2 | 2.07 | 51 | 22.8 |
| Comparative Example 3 | 2.15 | 56 | 34.7 |
| Comparative Example 4 | 1.86 | 48 | 16.8 |
| Comparative Example 5 | 3.89 | 29 | 17.3 |
| Comparative Example 6 | 2.05 | 55 | 18.0 |
| Comparative Example 7 | 2.14 | 61 | 23.4 |

| Comparative Examples | Properties of black composite particles: Tinting strength (%) | Light resistance (ΔE* value) (–) | Degree of desorption of black pigments (–) |
|---|---|---|---|
| Comparative Example 1 | 102 | 6.3 | 1 |
| Comparative Example 2 | 105 | 6.0 | 2 |
| Comparative Example 3 | 101 | 1.7 | — |
| Comparative Example 4 | 197 | 5.4 | 1 |
| Comparative Example 5 | 118 | 3.5 | 1 |
| Comparative Example 6 | 108 | 6.9 | 1 |
| Comparative Example 7 | 95 | 11.2 | — |

TABLE 9

| Examples | Production of black toner Black pigments | |
|---|---|---|
| | Kind | Amount blended (wt. part) |
| Example 17 | Example 6 | 15.0 |
| Example 18 | Example 7 | 15.0 |
| Example 19 | Example 8 | 15.0 |
| Example 20 | Example 9 | 15.0 |
| Example 21 | Example 10 | 15.0 |
| Example 22 | Example 11 | 15.0 |
| Example 23 | Example 12 | 15.0 |
| Example 24 | Example 13 | 15.0 |
| Example 25 | Example 14 | 15.0 |
| Example 26 | Example 15 | 15.0 |
| Example 27 | Example 16 | 15.0 |
| Example 28 | Example 6 | 10.0 |
| Example 29 | Example 9 | 10.0 |
| Example 30 | Example 10 | 10.0 |
| Example 31 | Example 11 | 10.0 |

| Examples | Production of black toner Binder resin | |
|---|---|---|
| | Kind | Amount blended (wt. part) |
| Example 17 | Styrene-acrylic copolymer resin | 76.5 |
| Example 18 | Styrene-acrylic copolymer resin | 76.5 |
| Example 19 | Styrene-acrylic copolymer resin | 76.5 |
| Example 20 | Styrene-acrylic copolymer resin | 76.5 |
| Example 21 | Styrene-acrylic copolymer resin | 76.5 |
| Example 22 | styrene-acrylic copolymer resin | 76.5 |
| Example 23 | Styrene-acrylic copolymer resin | 76.5 |
| Example 24 | Styrene-acrylic copolymer resin | 76.5 |
| Example 25 | Styrene-acrylic copolymer resin | 76.5 |
| Example 26 | styrene-acrylic copolymer resin | 76.5 |
| Example 27 | Styrene-acrylic copolymer resin | 76.5 |
| Example 28 | Polyester resin | 85.0 |
| Example 29 | Polyester resin | 85.0 |
| Example 30 | Polyester resin | 85.0 |
| Example 31 | Polyester resin | 85.0 |

TABLE 10

| Comparative Examples | Production of black toner Black pigments | |
|---|---|---|
| | Kind | Amount blended (wt. part) |
| Comparative Example 8 | Black pigments A | 15.0 |
| Comparative Example 9 | Black pigments B | 15.0 |
| Comparative Example 10 | Black pigments C | 15.0 |
| Comparative Example 11 | Comparative Example 1 | 15.0 |
| Comparative Example 12 | Comparative Example 2 | 15.0 |
| Comparative Example 13 | Comparative Example 3 | 15.0 |

TABLE 10-continued

| | | |
|---|---|---|
| Comparative Example 14 | Comparative Example 4 | 15.0 |
| Comparative Example 15 | Comparative Example 5 | 15.0 |
| Comparative Example 16 | Comparative Example 6 | 15.0 |
| Comparative Example 17 | Comparative Example 7 | 15.0 |
| Comparative Example 18 | Black pigments A | 10.0 |
| Comparative Example 19 | Comparative Example 1 | 10.0 |

| Comparative Examples | Production of black toner Binder resin | |
|---|---|---|
| | Kind | Amount blended (wt. part) |
| Comparative Example 8 | Styrene-acrylic copolymer resin | 76.5 |
| Comparative Example 9 | Styrene-acrylic copolymer resin | 76.5 |
| Comparative Example 10 | Styrene-acrylic copolymer resin | 76.5 |
| Comparative Example 11 | Styrene-acrylic copolymer resin | 76.5 |
| Comparative Example 12 | Styrene-acrylic copolymer resin | 76.5 |
| Comparative Example 13 | Styrene-acrylic copolymer resin | 76.5 |
| Comparative Example 14 | Styrene-acrylic copolymer resin | 76.5 |
| Comparative Example 15 | Styrene-acrylic copolymer resin | 76.5 |
| Comparative Example 16 | Styrene-acrylic copolymer resin | 76.5 |
| Comparative Example 17 | Styrene-acrylic copolymer resin | 76.5 |
| Comparative Example 18 | Polyester resin | 85.0 |
| Comparative Example 19 | Polyester resin | 85.0 |

TABLE 11

| Examples | Properties of black toner | | |
|---|---|---|---|
| | Average particle diameter (μm) | Degree of Dispersion condition (–) | Fluidity index (–) |
| Example 17 | 8.6 | 5 | 88 |
| Example 18 | 8.2 | 5 | 86 |
| Example 19 | 8.9 | 5 | 90 |
| Example 20 | 9.3 | 4 | 81 |
| Example 21 | 8.6 | 4 | 80 |
| Example 22 | 8.3 | 5 | 92 |
| Example 23 | 8.3 | 5 | 89 |
| Example 24 | 8.8 | 5 | 93 |
| Example 25 | 9.1 | 5 | 85 |
| Example 26 | 8.3 | 5 | 83 |
| Example 27 | 8.8 | 5 | 90 |
| Example 28 | 9.0 | 5 | 89 |
| Example 29 | 9.1 | 4 | 82 |
| Example 30 | 9.1 | 4 | 82 |
| Example 31 | 8.9 | 5 | 91 |

TABLE 11-continued

| Examples | Properties of black toner | | |
|---|---|---|---|
| | Blackness (L* value) (–) | Light resistance (ΔE* value) (–) | Volume resistivity value (Ω · cm) |
| Example 17 | 18.3 | 2.5 | $1.4 \times 10^{14}$ |
| Example 18 | 19.2 | 2.0 | $6.2 \times 10^{13}$ |
| Example 19 | 17.8 | 2.9 | $2.1 \times 10^{15}$ |
| Example 20 | 18.1 | 2.0 | $8.6 \times 10^{13}$ |
| Example 21 | 19.7 | 1.9 | $6.7 \times 10^{13}$ |
| Example 22 | 17.8 | 1.5 | $9.4 \times 10^{13}$ |
| Example 23 | 19.9 | 2.1 | $7.8 \times 10^{13}$ |
| Example 24 | 17.6 | 2.2 | $3.6 \times 10^{15}$ |
| Example 25 | 21.6 | 1.9 | $2.5 \times 10^{14}$ |
| Example 26 | 20.8 | 1.8 | $8.3 \times 10^{13}$ |
| Example 27 | 17.4 | 2.3 | $1.9 \times 10^{15}$ |
| Example 28 | 18.1 | 2.4 | $3.8 \times 10^{14}$ |
| Example 29 | 17.8 | 1.8 | $1.8 \times 10^{14}$ |
| Example 30 | 18.2 | 1.7 | $7.3 \times 10^{13}$ |
| Example 31 | 17.6 | 1.5 | $1.9 \times 10^{14}$ |

TABLE 12

| Comparative Examples | Properties of black toner | | |
|---|---|---|---|
| | Average particle diameter (μm) | Degree of Dispersion condition (–) | Fluidity index (–) |
| Comparative Example 8 | 9.3 | 2 | 65 |
| Comparative Example 9 | 9.1 | 1 | 64 |
| Comparative Example 10 | 8.6 | 1 | 61 |
| Comparative Example 11 | 8.3 | 1 | 65 |
| Comparative Example 12 | 8.7 | 2 | 64 |
| Comparative Example 13 | 9.0 | 3 | 71 |
| Comparative Example 14 | 8.6 | 1 | 63 |
| Comparative Example 15 | 8.8 | 1 | 58 |
| Comparative Example 16 | 9.1 | 2 | 70 |
| Comparative Example 17 | 8.8 | 3 | 74 |
| Comparative Example 18 | 8.9 | 2 | 68 |
| Comparative Example 19 | 8.9 | 2 | 66 |

| Comparative Examples | Properties of black toner | | |
|---|---|---|---|
| | Blackness (L* value) (–) | Light resistance (ΔE* value) (–) | Volume resistivity value (Ω · cm) |
| Comparative Example 8 | 20.2 | 4.4 | $3.6 \times 10^{13}$ |
| Comparative Example 9 | 21.5 | 4.7 | $1.4 \times 10^{12}$ |
| Comparative Example 10 | 21.8 | 7.5 | $4.5 \times 10^{15}$ |
| Comparative Example 11 | 23.8 | 7.8 | $8.1 \times 10^{12}$ |
| Comparative Example 12 | 23.3 | 7.2 | $9.3 \times 10^{12}$ |
| Comparative Example 13 | 35.1 | 2.7 | $3.3 \times 10^{13}$ |

TABLE 12-continued

| | | | |
|---|---|---|---|
| Comparative Example 14 | 18.9 | 6.0 | $4.6 \times 10^{12}$ |
| Comparative Example 15 | 20.6 | 4.6 | $1.6 \times 10^{13}$ |
| Comparative Example 16 | 21.0 | 8.1 | $2.2 \times 10^{13}$ |
| Comparative Example 17 | 24.2 | 12.0 | $8.7 \times 10^{13}$ |
| Comparative Example 18 | 20.0 | 4.1 | $3.8 \times 10^{13}$ |
| Comparative Example 19 | 23.6 | 7.8 | $9.6 \times 10^{12}$ |

TABLE 13

| Examples and Comparative Examples | Developing method | |
|---|---|---|
| | Kind of developing method | Kind of black toner |
| Example 32 | Developing method 1 | Example 18 |
| Example 33 | Developing method 2 | Example 19 |
| Example 34 | Developing method 1 | Example 28 |
| Example 35 | Developing method 2 | Example 29 |
| Example 36 | Developing method 1 | Example 30 |
| Example 37 | Developing method 2 | Example 31 |
| Comparative Example 20 | Developing method 1 | Comparative Example 9 |
| Comparative Example 21 | Developing method 1 | Comparative Example 11 |
| Comparative Example 22 | Developing method 1 | Comparative Example 18 |
| Comparative Example 23 | Developing method 1 | Comparative Example 19 |

| Examples and Comparative Examples | Image properties | | |
|---|---|---|---|
| | Image density (–) | Image durability (%) | Image fogging (ΔL* value) (–) |
| Example 32 | 1.56 | 3.6 | 1.48 |
| Example 33 | 1.55 | 4.0 | 1.49 |
| Example 34 | 1.59 | 3.8 | 1.41 |
| Example 35 | 1.58 | 4.3 | 1.58 |
| Example 36 | 1.61 | 3.4 | 1.46 |
| Example 37 | 1.60 | 3.5 | 1.47 |
| Comparative Example 20 | 1.05 | 13.8 | 5.12 |
| Comparative Example 21 | 1.03 | 14.3 | 4.96 |
| Comparative Example 22 | 1.06 | 14.6 | 5.38 |
| Comparative Example 23 | 1.04 | 14.8 | 5.16 |

What is claimed is:

1. A black toner comprising black composite particles having an average particle diameter of 0.005 to 0.30 μm, and a binder resin, said black composite particles comprising:

extender pigments as core particles;

a gluing agent-coating layer formed on surface of the respective core particles; and a black pigment coat uniformly formed on the gluing agent-coating layer in an amount of 1 to 500 parts by weight based on 100 parts by weight of the extender pigments.

2. A black toner according to claim 1, wherein said gluing agent is at least one material selected from the group consisting of organosilicon compounds and coupling agents.

3. A black toner according to claim 2, wherein said organosilicon compound is at least one compound selected from the group consisting of:

(1) organosilane compounds obtainable from alkoxysilane compounds, (2) polysiloxanes or modified polysiloxanes, and (3) fluoroalkyl organosilane compounds obtainable from fluoroalkylsilane compounds, and said coupling agent is at least one selected from the group consisting of silane-based coupling agents, titanate-based coupling agents, aluminate-based coupling agents and zirconate-based coupling agents.

4. A black toner according to claim 1, wherein said gluing agent is organosilane compounds obtainable from alkoxysilane compounds, or polysiloxanes.

5. A black toner according to claim 1, wherein said black composite particles have a BET specific surface area value of 15 to 500 $m^2/g$; a blackness (L* value) of not more than 22.0; a specific gravity of 1.3 to 3.5; and a fluidity index of not less than 45.

6. A black toner according to claim 1, wherein said black composite particles are contained in an amount of 1.2 to 20.0% by weight based on the weight of the black toner.

7. A black toner according to claim 1, wherein said binder resin is at least one resin selected from the group consisting of polyester-based resins, epoxy-based resins, polyolefin-based resins, polyurethane-based resins, vinyl-based polymers and styrene-butadiene copolymers.

8. A black toner according to claim 1, wherein said extender pigments are at least one material selected from the group consisting of silica particles, clay, calcium carbonate particles, barium sulfate particles, alumina white particles, talc, transparent titanium oxide particles and satin white particles.

9. A black toner according to claim 1, wherein said extender pigments have a sphericity (average particle diameter/average minimum diameter) of from 1.0 to less than 2.0; an average particle diameter of 0.004 to 0.29 $\mu$m; and a specific gravity of 1.3 to 4.2.

10. A black toner comprising black composite particles having an average particle diameter of 0.005 to 0.30 $\mu$m, and a binder resin, said black composite particles comprising:

extender pigments as core particles;

a coating layer formed the surface of the respective extender pigments, comprising at least one compound selected from the group consisting of hydroxides of aluminum, oxides of aluminum, hydroxides of silicon and oxides of silicon;

a gluing agent-coating layer formed on said coating layer; and a black pigment coat uniformly formed on the gluing agent-coating layer in an amount of 1 to 500 parts by weight based on 100 parts by weight of the extender pigments.

11. A black toner having an average particle diameter of 3 to 25 $\mu$m; a L* value of not more than 22.0; and a fluidity index of 76 to 100, and comprising a binder resin and black composite particles having an average particle diameter of 0.005 to 0.30 $\mu$m, said black composite particles comprising:

extender pigments as core particles;

a gluing agent-coating layer formed on surface of the respective core particles; and a black pigment coat uniformly formed on the gluing agent-coating layer in an amount of 1 to 500 parts by weight based on 100 parts by weight of the extender pigments.

12. A black toner comprising black composite particles having an average particle diameter of 0.005 to 0.30 $\mu$m, and a binder resin, said black composite particles comprising:

extender pigments as core particles;

a gluing agent-coating layer formed on surface of the respective core particles; and a black pigment coat uniformly formed on the gluing agent-coating layer in an amount of 1 to 500 parts by weight based on 100 parts by weight of the extender pigments, said black pigments being carbon black, aniline black, or both of carbon black and aniline black.

13. A black toner comprising black composite particles having an average particle diameter of 0.005 to 0.30 $\mu$m, and a binder resin, said black composite particles comprising:

extender pigments as core particles;

a coating layer disposed on the surface of the respective extender pigments, which comprises at least one compound selected from the group consisting of hydroxides of aluminum, oxides of aluminum, hydroxides of silicon and oxides of silicon;

a gluing agent-coating layer formed on surface of the respective core particles; and a black pigment coat uniformly formed on the gluing agent-coating layer in an amount of 1 to 500 parts by weight based on 100 parts by weight of the extender pigments.

14. A black toner having a light resistance ($\Delta E^*$ value) of not more than 4.0 and a volume resistivity value of not less than $1.0\times10^{13}$ $\Omega\cdot$cm, the black toner comprising black composite particles having an average particle diameter of 0.005 to 0.30 $\mu$m, and a binder resin, said black composite particles comprising:

extender pigments as core particles;

a gluing agent-coating layer formed on surface of the respective core particles; and a black pigment coat uniformly formed on the gluing agent-coating layer in an amount of 1 to 500 parts by weight based on 100 parts by weight of the extender pigments.

* * * * *